US008478166B2

(12) United States Patent
Hara et al.

(10) Patent No.: US 8,478,166 B2
(45) Date of Patent: Jul. 2, 2013

(54) ELECTROPHOTOGRAPHIC IMAGE FORMING APPARATUS HAVING REMOVABLE CARTRIDGE WITH COUPLING MEMBER

(75) Inventors: Nobuyoshi Hara, Mishima (JP); Masanari Morioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 458 days.

(21) Appl. No.: 12/708,787

(22) Filed: Feb. 19, 2010

(65) Prior Publication Data

US 2010/0221036 A1 Sep. 2, 2010

(30) Foreign Application Priority Data

Feb. 27, 2009 (JP) ..... 2009-045057

(51) Int. Cl.
*G03G 15/02* (2006.01)

(52) U.S. Cl.
USPC ..... 399/167

(58) Field of Classification Search
USPC ..... 399/167, 110, 111, 117
See application file for complete search history.

(56) References Cited

U.S. PATENT DOCUMENTS

| | | | | |
|---|---|---|---|---|
| 5,160,946 | A | 11/1992 | Hwang | |
| 2006/0240896 | A1 * | 10/2006 | Ohashi et al. | 464/158 |
| 2008/0152388 | A1 * | 6/2008 | Ueno et al. | 399/167 |
| 2008/0240796 | A1 | 10/2008 | Morioka et al. | |

FOREIGN PATENT DOCUMENTS

| | | | |
|---|---|---|---|
| JP | 1-006981 | | 1/1989 |
| JP | 01006981 | A * | 1/1989 |
| JP | 5-241457 | | 9/1990 |
| JP | 05241457 | A * | 9/1993 |
| JP | 2004-145077 | | 5/2004 |
| JP | 2004145077 | A * | 5/2004 |

* cited by examiner

*Primary Examiner* — Walter L Lindsay, Jr.
*Assistant Examiner* — Billy J Lactaoen
(74) *Attorney, Agent, or Firm* — Fitzpatrick, Cella, Harper & Scinto

(57) ABSTRACT

A cartridge mountable in an image forming apparatus includes a rotatable member, a hollow cylindrical portion, having first and second inner grooves, that transmits a rotational force to the rotatable member, a coupling member having a spherical base portion and an axially movable pin penetrating the spherical base portion and having first and second end portions projected outside the base portion, and a limiting portion, provided in the first inner groove, for limiting axial movement of the pin. When the coupling member is inclined to a maximum extent within a predetermined inclination range, after movement of the pin is limited, so that the first end portion moves away, and the second end portion moves toward, the rotatable member, the first end portion is disengaged from the first inner groove, whereas the second end portion is engaged with the second inner groove.

7 Claims, 41 Drawing Sheets

(a)

(b)

(c)

(a)

(b)

(a)

(b)

(a)

(b)

ELECTROPHOTOGRAPHIC IMAGE FORMING APPARATUS HAVING REMOVABLE CARTRIDGE WITH COUPLING MEMBER

FIELD OF THE INVENTION AND RELATED ART

The present invention relates to a cartridge mountable and dismountable relative to the main assembly by being moved in the direction crossing with an axial direction of a drive shaft of a main assembly of an electrophotographic image forming apparatus, and relates to an electrophotographic image forming apparatus loaded by this.

The electrophotographic image forming apparatuses include an electrophotographic copying machine and an electrophotographic printer (laser beam printer and LED printer or the like).

For example, the cartridge is a process cartridge or a developing cartridge, and it is dismountably mounted to the electrophotographic image forming apparatus main assembly to contribute to an image forming process for forming an image on a recording material.

Here, the process cartridge includes an electrophotographic photosensitive member and the process means which functions on the electrophotographic photosensitive member, integrally, and is mounted and demounted relative to the main assembly of the electrophotographic image forming apparatus. An example of the process cartridge includes the electrophotographic photosensitive member and at least one of the developing means, charging means, and cleaning means as the process means integrally. An example of the developing cartridge includes a cartridge type developing means integrally.

Here, the process cartridge and the developing cartridge can be mounted and demounted by a user relative to a main assembly. Therefore, maintenance of a device can be carried out in effect by the user, without depending on a service person. By this, operativity in a maintenance operation of an image forming apparatus is improved.

A cartridge type is known in the field of the electrophotographic image forming apparatus in which an electrophotographic photosensitive drum (photosensitive drum) and the process means which functions on the photosensitive drum are integrated into a cartridge as a unit or in which the developing means is integrated into a cartridge as a unit, wherein such cartridges are detachably mountable to the image forming apparatus main assembly. According to this cartridge type, the maintenance of the device can be carried out for an operator by himself or herself without relying on the service person, and therefore, the operativity can remarkably be improved. For this reason, this cartridge type is widely used in the field of electrophotographic image forming apparatus.

On mounting and demounting the such a cartridge in the direction perpendicular to a drive shaft thereof relative to the main assembly of the electrophotographic image forming apparatus, it is necessary that a rotational force applying portion for transmitting a rotational force from the electrophotographic image forming apparatus main assembly to the cartridge and a rotational force receiving portion for driving the cartridge by engaging with the rotational force applying portion are engaged and disengaged relative to each other.

In the conventional engagement and disengagement structure, a coupling which is provided with the rotational force receiving portion swings relative to the cartridge between a rotational force transmitting angular position for transmitting the rotational force and a mounting-and-dismounting angular position inclined from there, by which the engagement and disengagement of the rotational force receiving portion is carried out (US2008-0152388 and US 2008-0240796). With this structure, the coupling is provided with a portion for receiving the rotational force from the main assembly and a portion for transmitting the drive to a photosensitive drum or a developing roller. In a part for the transmitting portion, a pin (rotational-driving-force-transmitting member) is inserted into a hole provided in the coupling, and the rotational force is transmitted through the pin.

However, according to the conventional structure, each time the coupling repeats a rotation and a stoppage, the pin might receive a force in the direction of escaping from a through-hole. It would be considered that an insertion pressure between the coupling and the pin are raised to fix the pin strongly, or the pin and the coupling are fixed with each other with an adhesive material.

However, in order to raise insertion pressure, the increase of a dimensional accuracy of the through-hole is required, and the material which does not break easily must be used, and therefore, the material selection is limited. In the case of the bonding, a difficulty of an assembling rises and the man-hour increases. In increasing an engagement depth between a flange on which the coupling is mounted and the pin, a configuration inside a flange and a space are limiting factors.

SUMMARY OF THE INVENTION

Accordingly, it is an object of the present invention to provide a cartridge and an electrophotographic image forming apparatus wherein the movement of the rotational-driving-force-transmitting member relative to a coupling member is restricted by a regulating portion, by which the mounting, the management of the rotational-driving-force-transmitting member which is engaged with the coupling member is easy.

It is another object of the present invention to provide a cartridge and an electrophotographic image forming apparatus wherein the engagement depth between the rotational-driving-force-transmitting member and a rotational force transmitted portion can be assured without narrowing a swinging range of a coupling assembly.

According to an aspect of the present invention there is provided a cartridge mountable and dismountable by moving in a direction crossing with an axial direction of a drive shaft relative to a main assembly of an electrophotographic image forming apparatus, said main assembly being provided with the drive shaft which is provided with a rotational force applying portion, comprising i) a rotatable member which is rotatable about an axis by receiving a rotational force from the main assembly of the electrophotographic image forming apparatus; ii) a coupling assembly engageable with the rotational force applying portion to receive a force for rotating said rotatable member, said coupling assembly including a coupling member rotatable about an axis, a first rotational force receiving portion, provided at one end portion of said coupling member with respect to a direction of the axis of said coupling member, for receiving the rotational force from the driving shaft, a rotational force transmission member engaged with the other end portion of said coupling member and having opposite ends projected out in a direction crossing with the axial direction of said coupling member wherein said coupling member is pivotable between a rotational force transmitting angular position for transmitting the rotational force from the driving shaft to said rotatable member and a mounting-and-dismounting angular position which is inclined relative to the axis of said rotatable member; iii) a flange mounted to said rotatable member and rotatable about an axis, said flange including an opening accommodating said rotational force transmission member with a gap, a regulating portion, provided in said opening, for regulating movement of said rotational force transmission member in the crossing direction when said coupling assembly takes the rotational force transmitting angular position, a second rotational force receiving portion for being abutted by said rotational force transmission member to receive the rotational force from said coupling assembly, an opposing portion opposing to said second rotational force receiving portion, wherein in a state that said coupling assembly is in the rotational force transmitting angular position and that one end of said rotational force transmission member contacts to said regulating portion to be confined in movement, when said coupling assembly inclines relative to said flange such that a side in which a projection distance of said rotational force transmission member is relatively smaller moves away from said first rotational force receiving portion, an engagement depth between said side of said rotational force transmission member and said second rotational force receiving portion and an engagement depth between said side of said rotational force transmission member and said opposing portion are larger than zero.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENT

The preferred embodiments of the present invention will be described in conjunction with the accompanying drawings <cartridge and electrophotographic image forming apparatus>

<First Embodiment>

<General Arrangement>

Figure 1:
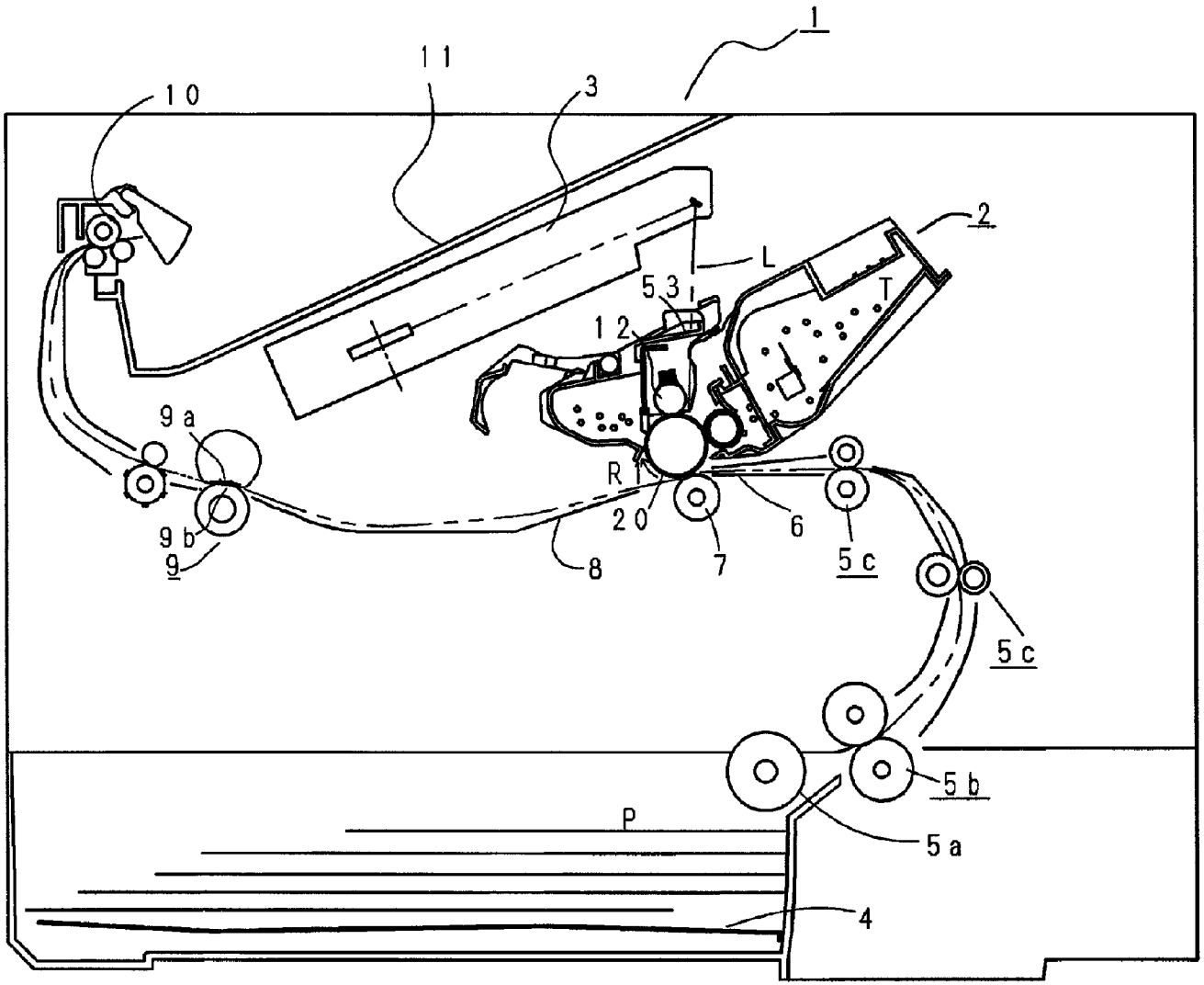
FIG. 1 is a sectional view of a main assembly and a process cartridge which constitute an image forming apparatus according to an embodiment of the present invention.
Figure 2:
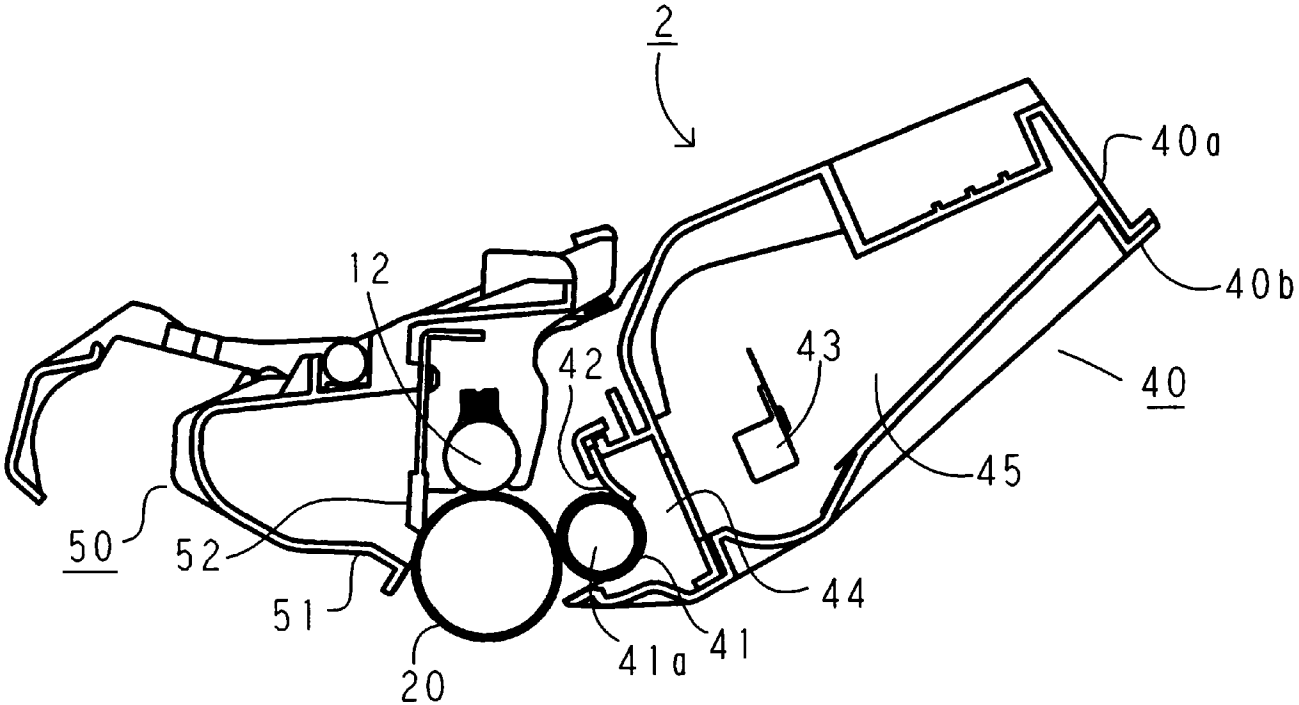
FIG. 2 is a sectional view of the process cartridge according to the embodiment of the present invention.

FIG. 1 is a sectional view of a main assembly 1 and a process cartridge 2 of an electrophotographic image forming apparatus according to the embodiment. FIG. 2 is a sectional view of the process cartridge 2 according to the embodiment. Referring to FIGS. 1 and 2, the general arrangement of the image forming apparatus and an image forming process will be described.

In this image forming apparatus, the process cartridge (cartridge) 2 is detachably mountable to the main assembly 1 of the electrophotographic image forming apparatus. It is a laser printer of an electrophotographic type. When the cartridge 2 is mounted to the main assembly 1, the upper portion of the cartridge 2 is provided with an exposure device (laser scanner unit) 3. The lower portion of the cartridge 2 is provided with a sheet tray 4 for containing a recording material (sheet material) P. Furthermore, the main assembly 1 is provided with a pick-up roller 5*a*, a feeding roller 5*b*, a feeding roller pair 5*c*, a transfer guide 6, a transfer charging roller 7, a feeding guide 8, a fixing device 9, a discharging roller pair 10, and a discharging tray 11, and so on along a feeding direction of a sheet material P.

<Image Forming Process>

An outline of the image forming process will be described. On the basis of a print start signal, the electrophotographic photosensitive drum (photosensitive drum) 20 is rotated with a predetermined peripheral speed (process speed) in the direction of the arrow R1. A charging roller 12 which is supplied with a bias voltage contacts to an outer surface of a photosensitive drum 20 to uniformly charge the outer surface of the photosensitive drum 20.

A laser scanner unit 3 outputs a laser beam L modulated correspondingly to a serial electrical digital pixel signal of image information. The laser beam L enters an inside of the cartridge 2 through an exposure window 53 of an upper surface of the cartridge 2 to scanningly expose the outer surface of the photosensitive drum 20. By this, on the outer surface of the photosensitive drum 20 an electrostatic latent image corresponding to the image information is formed. This electrostatic latent image is visualized by a developer (toner) in a developing device unit 40 into a toner image.

The charging roller 12 is contacted to the photosensitive drum 20 to charge the photosensitive drum 20. The charging roller 12 is rotated by the photosensitive drum 20. The developing device unit 40 supplies the toner to a developing zone of the photosensitive drum 20 to develop a latent image formed on the photosensitive drum 20.

The developing device feeds the toner T in a toner chamber 45 into a toner feeding chamber 44 by a rotation of a stirring member 43. A developing roller 41 which is a developer carrying member contain therein magnet roller (stationary magnet) 41*a*. With the rotation thereof, the toner receives a triboelectrical charge by a developing blade 42, and a toner layer is formed on a surface of the developing roller 41. The toner is transferred onto the photosensitive drum 20 in accordance with the latent image, by which the latent image is visualized into a toner image.

The developing blade 42 regulates a toner amount on the peripheral surface of the developing roller 41, and applies the triboelectric charge to the toner.

On the other hand, in timed relation with the output of the laser beam L, and, the sheet material P accommodated in the lower portion of the main assembly 1 is fed from the sheet tray 4 by the pick-up roller 5*a*, the feeding roller 5*b*, and the feeding roller pair 5*c*. The sheet material P thereof is timely fed to a transfer position between the photosensitive drum 20 and the transfer charging roller 7 via the transfer guide 6. In this transfer position, the toner image is sequentially transferred onto the sheet material P from the photosensitive drum 20.

The sheet material P onto which the toner image has been transferred is separated from the photosensitive drum 20, and is fed into the fixing device 9 along the feeding guide 8. The sheet material P passes through a nip between a fixing roller 9*a* and a pressing roller 9*b* which constitutes the fixing device 9. The toner image is pressed and heated by the nip to fix on the sheet material P. The sheet material P having been subjected to the fixing process is fed by the discharging roller pair, and is discharged to the discharging tray 11.

On the other hand, as for the photosensitive drum 20 after the image transfer, a residual toner on the outer surface is removed by a cleaning blade 52, and the drum is subjected to an image formation which begins from the charging again.

<Frame Structure of Cartridge>

Figure 3:
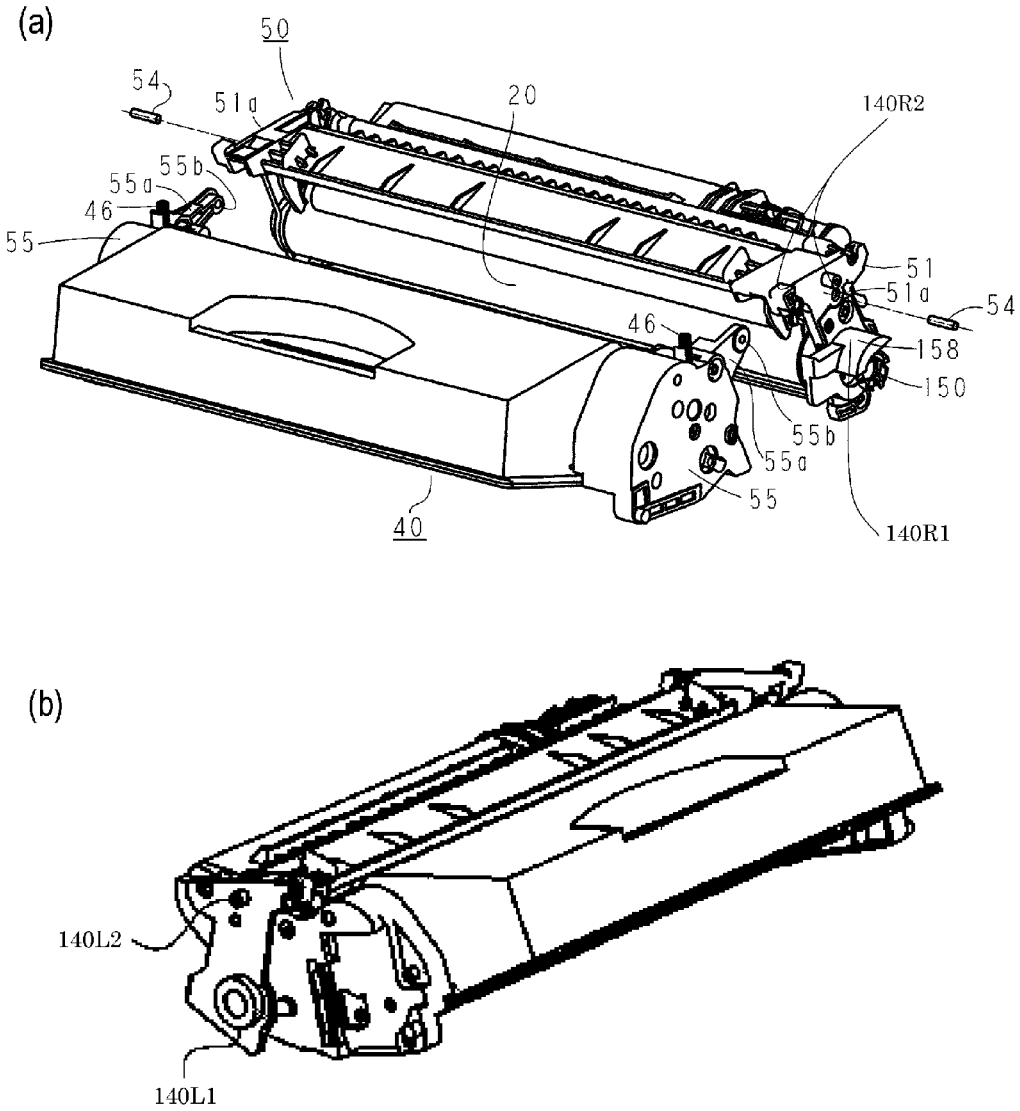
FIG. 3 is a perspective view illustrating a frame structure of the process cartridge according to the embodiment of the present invention.

Referring to FIG. 2 and FIG. 3 the description will be made as to the frame structure of the cartridge 2 of this embodiment. FIG. 3 is a perspective view of a cartridge frame of this embodiment.

As shown in FIG. 2, the photosensitive drum 20, the charging roller 12, and the cleaning blade 52 are mounted to a drum frame 51 to constitute an integral photosensitive member unit 50.

On the other hand, the developing device unit 40 comprises a toner chamber 45 which accommodates the toner, a toner accommodating chamber 40 which forms the toner feeding chamber 44*a*, and a cover 40*b*. The toner accommodating chamber 40*a* and the cover 40*b* are connected integrally by welding or the like.

As shown in FIG. 3, the photosensitive member unit 50 and the developing device unit 40 are rotatably connected by the connection member 54 of the round pin with each other by which the cartridge 2 is constituted.

As shown in FIG. 3, more particularly, a side cover 55 is provided in each side of the developing device unit 40 with respect to a longitudinal direction (axial direction of the developing roller 41), and is provided with an arm portion 55*a*, and a free end of the arm portion 55*a* is provided with a round rotation hole 55 in parallel with the developing roller 41*b*.

The drum frame 51 is provided with an engaging hole 51 for receiving the connecting member 54 co-axial with the rotation hole 55*b* a (left engaging hole is unshown in an FIG. 3) when the arm portion 55*a* is inserted into a predetermined position of the drum frame 51.

The connecting member 54 is inserted into both of the rotation hole 55*b* and the engaging hole 51*a* s, by which the photosensitive member unit 50 and the developing device unit 40 are connected with each other for rotation about the connecting member. At this time, a compression coil spring 46 mounted to a base portion of the arm portion 55*a* abuts to the drum frame 51 to urge the developing device unit 40 downwardly. By this, the developing roller 41 (FIG. 2) is assuredly pressed toward the photosensitive drum 20.

A spacer member (unshown) is mounted to the each end of the developing roller 41, and the developing roller 41 is spaced with the predetermined gap from the photosensitive drum 20.

<The Cartridge Rotational Force Transmission Method>

Figure 4:
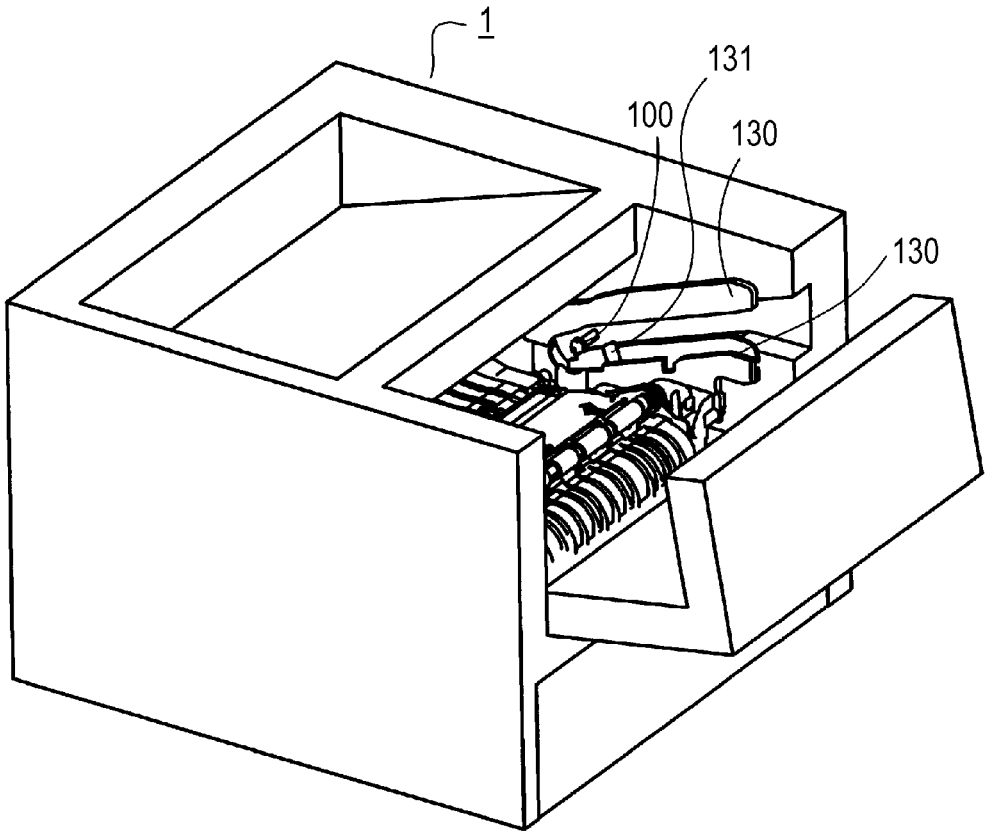
FIG. 4 is a perspective view of a main assembly according to the embodiment of the present invention.

FIG. 4 is a perspective view of the apparatus main assembly according to this embodiment. Referring to FIG. 4, the cartridge rotational force transmission method will be described.

As shown in FIG. 4, the main assembly 1 is provided with a mounting and demounting guiding rail 130 for constituting mounting means for the cartridge 2, and the cartridge 2 is mounted into the main assembly 1 along the mounting and demounting guiding rail 130.

In this case, in interrelation with a mounting operation of the cartridge 2 the drive shaft 100 of the main assembly 1 connects with the coupling member 150 (coupling, FIG. 3) which is a rotational force transmitting portion of the cartridge 2. By this, the photosensitive drum 20 which is a rotatable member receives a rotational force from the main assembly 1 to rotate.

<Drive Shaft>

Figure 5:
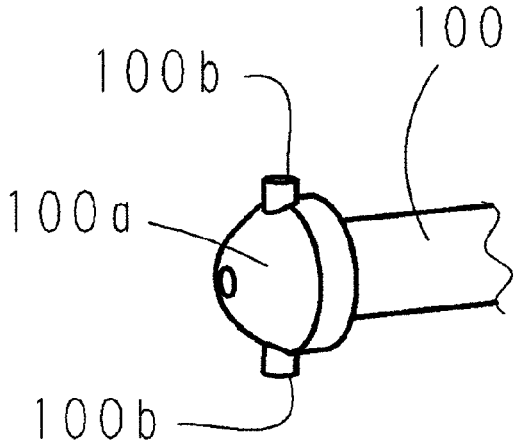
FIG. 5 is a perspective view of a drive shaft of the main assembly according to the embodiment of the present invention.

FIG. 5 is a perspective view of the drive shaft of the main assembly according to this embodiment.

The drive shaft 100 (FIG. 5) is coupled with the drive transmitting means of a unshown gear train or the like and a motor provided in the main assembly 1.

A free end portion 100*a* of the drive shaft 100 has a form of a substantially semispherical surface, and is provided with a rotational force drive transmission pins 100*b* as rotational force applying portions.

<Coupling>

Figure 6:
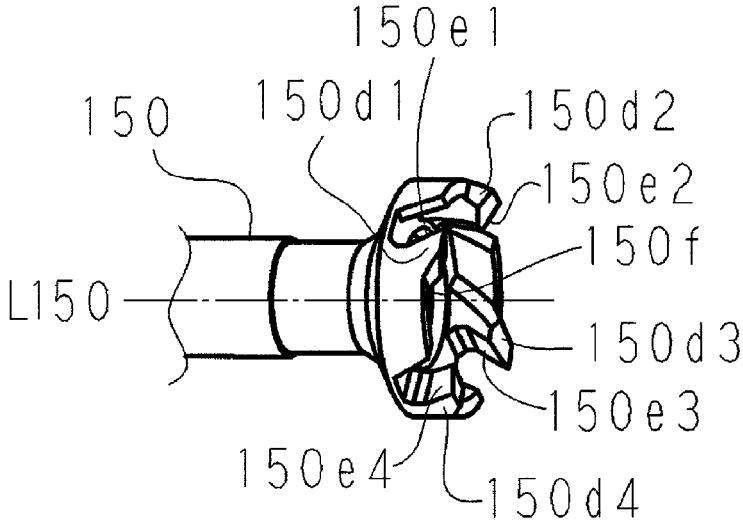
FIG. 6 is a perspective view of a coupling member according to the embodiment of the present invention.

FIG. 6 is a perspective view of the coupling 150 according to this embodiment.

A material of the coupling 150 is resin material such as polyacetal, polycarbonate, PPS or the like PPS, for example. However, in order to raise the rigidity of the coupling 150, a glass fiber, a carbon fiber or the like may be mixed in the resin material in accordance with a required load torque. By using such a material, the rigidity of the coupling 150 can be raised. By inserting a metal in the resin material, the rigidity may further be raised or the whole coupling may be of metal.

The free end of the coupling 150 is provided with a plurality of drive receiving projections 150*d* (150*d*1-150*d*4). The drive receiving projection 150*d* (150*d*1-150*d*4) is provided with a rotational force receiving portion 150*e* for receiving the rotational force from the drive shaft 100 (150*e*1-150*e*4), and it is inclined relative to an axis L150 of the coupling 150.

Furthermore, the inside of the drive receiving projection 150*d*1-150*d*4 is provided with a funnel-like driving shaft receiving surface 150*f*.

<Drive Shaft and Connection State Between Coupling>

Figure 7:
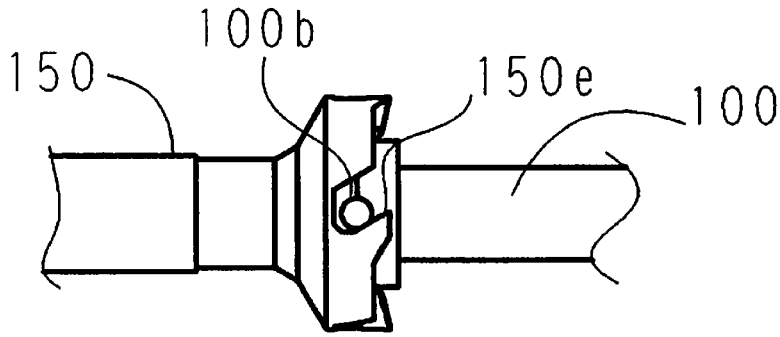
FIG. 7 is an illustration showing the state that the coupling member and the drive shaft according to the embodiment of the present invention connect with each other.
Figure 8:
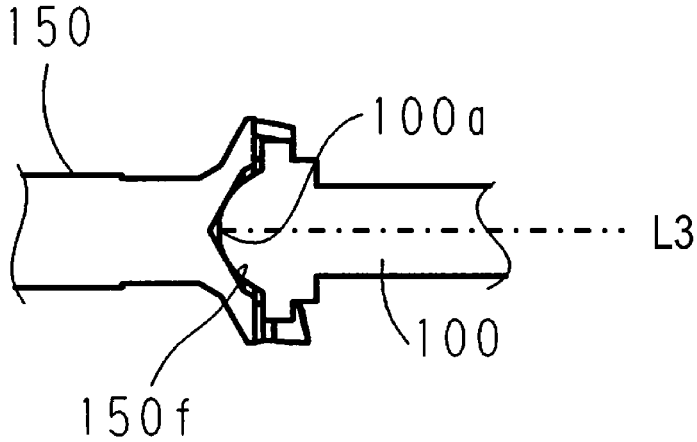
FIG. 8 is a sectional view illustrating the state that the coupling member and the drive shaft according to the embodiment of the present invention connect with each other.

Referring to FIGS. 7 and 8, the connection state between the drive shaft and the coupling will be described. FIG. 7 is an illustration of the state that the coupling according to this embodiment and the drive shaft connect with each other. FIG. 8 is a sectional view illustrating the state that the coupling according to this embodiment and the drive shaft connect with each other.

As shown in FIG. 7, the rotational force drive transmission pin 100 of the drive shaft 100*b* is in engagement with the rotational force receiving portion 150*e* (150*e*1-150*e*4). Although it does not appeared in FIG. 7, the rotational force drive transmission pin 100 on a back side b is also in engagement with the rotational force receiving portion 150*e*. As shown in FIG. 8, the free end portion 100 of the drive shaft 100*a* is in contact with the driving shaft receiving surface 150 of the coupling 150*f*.

By the drive shaft 100 rotating about an axis L3, the rotational force is transmitted from the rotational force drive transmission pin 100*b* to the rotational force receiving portion 150*e*. The rotational force receiving portion 150*e* inclines in a rotational direction relative to the axis L 150 of the coupling 150, and therefore, the coupling 150 and the drive shaft 100 are attracted to each other, the free end portion 100*a* and the driving shaft receiving surface 150*f* contact to each other assuredly to provide a stabilized rotational force transmission.

<Coupling Assembly (Spherical Member and Coupling)>

Figure 9:
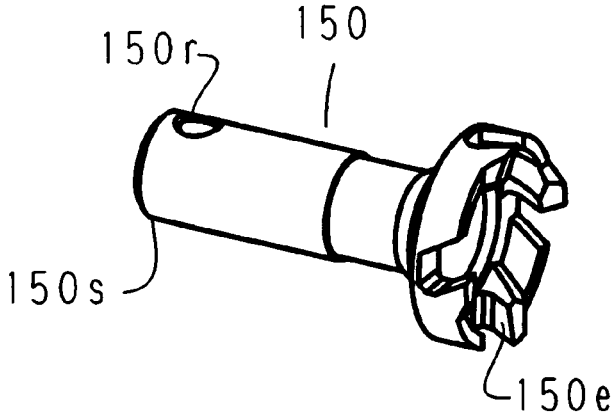
FIG. 9 is a perspective view illustrating the coupling member according to the embodiment of the present invention.
Figure 10:
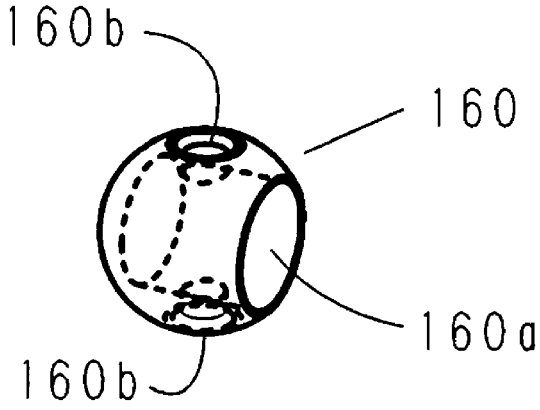
FIG. 10 is a perspective view illustrating a spherical member according to the embodiment of the present invention.

Referring to FIGS. 9 and 10, a part connected with the coupling will be described. FIG. 9 is a perspective view illustrating the coupling, and FIG. 10 is a perspective view illustrating the spherical member.

As shown in FIG. 9, an end portion 150 at the coupling 150 side opposite from the rotational force receiving portion 150*e* s is provided with a through-hole 150*r*. As shown in FIG. 10, the spherical member (rotatable part) 160 which connects with the coupling 150 and which has a rotatable configuration has a substantially spherical shape, and is provided with one-end-closed-hole 160*a*. The one-end-closed-hole 160*a* receives the other end portion 150 of the coupling s. A through-hole 160*b* extends through the one-end-closed-hole 160*a*. The through-hole 160*b* is penetrated by the pin 155 as will be described hereinafter.

Figure 11:
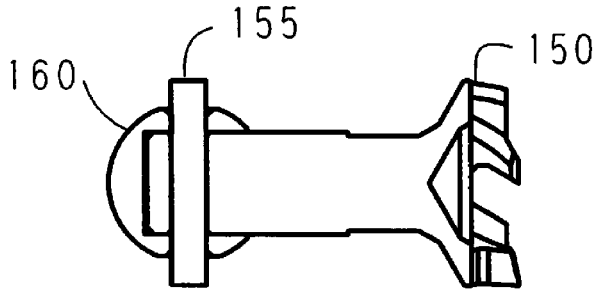
FIG. 11 is a sectional view illustrating the coupling member and a connecting part according to the embodiment of the present invention.
Figure 12:
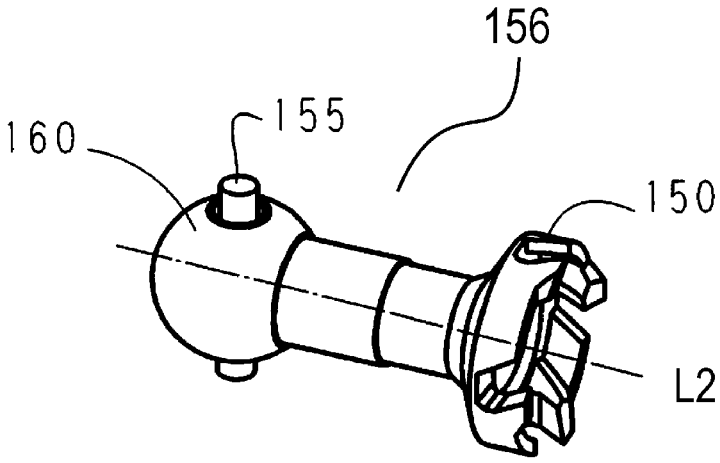
FIG. 12 is a perspective view illustrating the coupling member and the connecting part according to the embodiment of the present invention.

Referring to FIGS. 11 and 12, the connection state of the coupling 150, the spherical member 160, and the pin 155 will be described. FIG. 11 is a sectional view illustrating the coupling and the connecting part, and FIG. 12 is a perspective view illustrating the coupling and the connecting part.

The coupling 150 is inserted into the one-end-closed-hole 160 provided in the spherical member 160*a*, the pin 155 which is a rotational-driving-force-transmitting member is inserted with the aligned the through-hole 150*r* and the through-hole 160*b*.

In this embodiment, the connection between the coupling 150 and the one-end-closed-hole 160*a* is a loose-fit, and the connection between the pin 155 and the through-hole 150*r* is a loose-fit. However, the connection between the pin 155 and the through-hole 160*b* is a press-fit. By this, the coupling assembly 156 which is provided with the rotational force receiving portion 150 for receiving the rotational force from the drive shaft 100*e* at the one end of the coupling 150 with respect to the axial direction and which is provided with the coupling 150, the spherical member 160, and the pin 155 which are integral at the other end is provided.

<Drum Flange>

Figure 13:
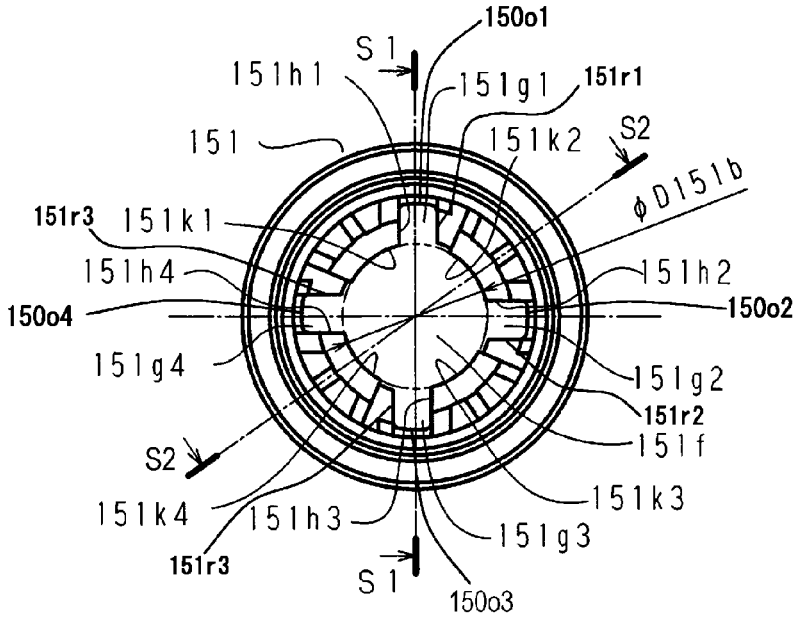
FIG. 13 is an illustration illustrating a drum flange according to the embodiment of the present invention.
Figure 14:
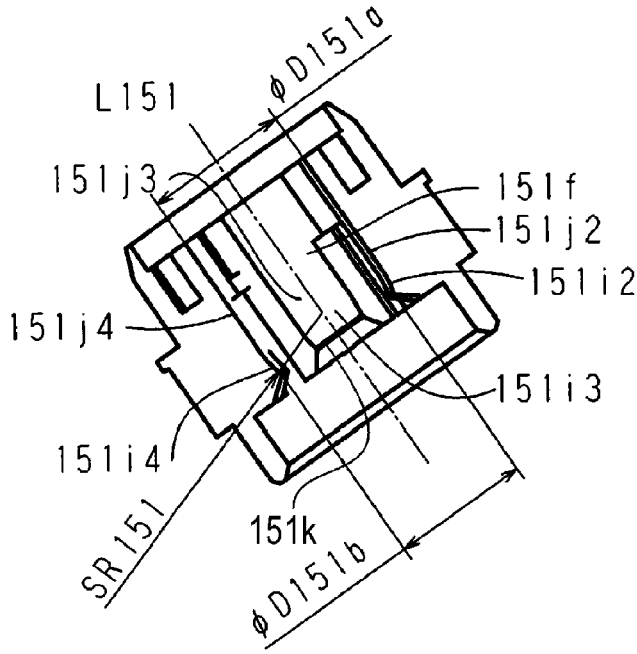
FIG. 14 is a sectional view taken along S2-S2 of FIG. 13 in the embodiment of the present invention.

Referring to FIG. 13 and FIG. 14 an example of the drum flange 151 to which the coupling 150 is mounted (flange) will be described. FIG. 13 is a view of the flange 151, as seen from the drive shaft 100 side. FIG. 14 is a sectional view taken along S2-S2 of FIG. 13.

As indicated by FIG. 13, four opening portions 151*g* (151*g*1-151*g*4) is the groove which extends in a rotational axis direction of the flange 151. In mounting the coupling 150 to the flange 151 the pin 155 is received in the two of the opening portions 151*g*1-151*g*4.

The upstream side, with respect to a clockwise direction, of the opening portions 151*g*1-151*g*4 is provided with rotational force transmitted portion 151*h* (151*h*1-151*h*4), and the pin 155 and the rotational force transmitted portion 151*h* contact to each other when the rotational force is transmitted to the flange 151 from the pin 155.

The downstream side, with respect to the clockwise direction, of the opening portions 151*g*1-151*g*4 is provided with a rotational force transmitting opposing portions 151*r* (151*r*1-151*r*4), and the pin 155 contacts to it when the coupling assembly 156 is rotated in the direction opposite a direction of the drive transmission.

The outside of the opening portion 151, g1-151, g4, with respect to a radial direction, of the flange 151 is provided with a regulating portion 151*o* (151*o*1,-151*o*4,) to limit a movement distance of the pin 155. The regulating portion 1510 will be described hereinafter.

A space (recess 151*f*) is formed in a neighborhood of the central axis L 151 of the flange 151. The recess 151*f* is surrounded by the cylindrical surfaces 151*j* (151*j*1-151*j*4), a retaining portions 151*i* (151*i*1-151*i*4), and opening 151*k*.

The cylindrical surface 151*j* has a substantially spherical surface which is adjacent to the opening portion 151*g* and which has the flange axis 151 as the center axis thereof L, and has a diameter ϕD151*a*. The retaining portion 151*i* has a substantially semispherical surface which is smoothly continuous of the cylindrical surface 151*j*, and a radius thereof is SR151. The opening 151*k* is placed in the drive shaft 100 side of the retaining portion 151*i*, the diameter thereof is ϕD151*b*.

The relation relative to an outside dimension ϕD160 of the spherical member 160 is as follows.

$$\phi D151b<\phi D160<\phi D151a\approx 2\times SR151$$

The spherical member 160 can be inserted with the gap into the recess 151*f*, but, it is prevented from moving toward the opening 151 (*k*) of the axis L151 of the flange. By this regulation, the spherical member 160 (coupling assembly 156) does not separate from the flange 151 (cartridge 2) under the normal service condition. The spherical member 160 is rotatable within the inside of the recess 151*f*. In this embodiment, the spherical member 160 is exemplified as the rotatable part accommodated in the recess 151*f*, but, it may not be the globular form but may be the other configuration (cylinder, for example), if it is not be disengaged from the recess 151*f* and it is rotatable.

<Assemblying of Coupling Assembly (Spherical Member and Coupling)>

Figure 15:
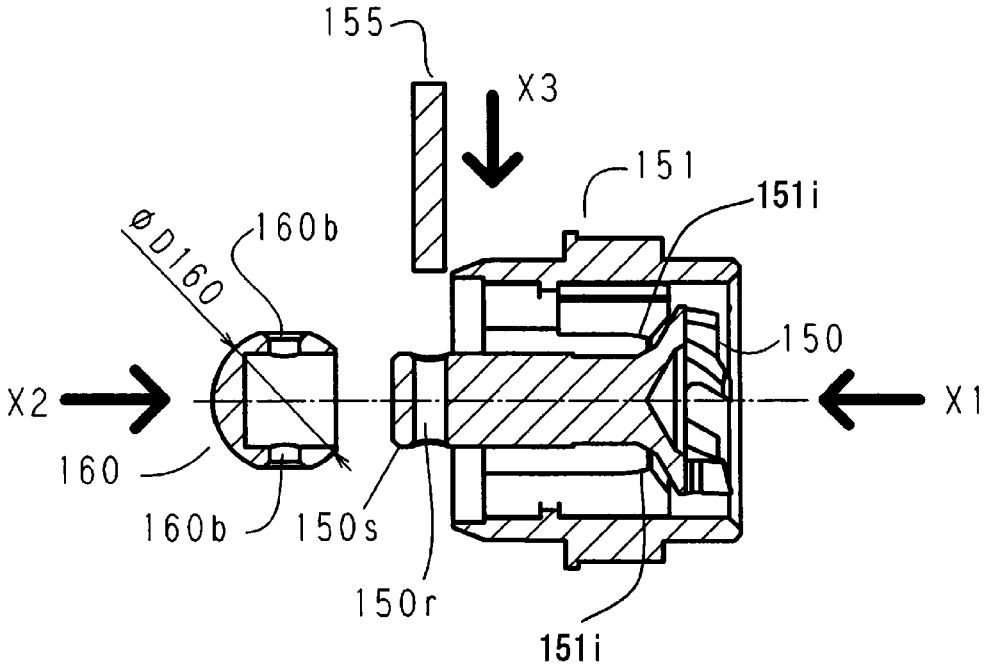
FIG. 15 is a sectional view which illustrates a process in which a coupling assembly according to the embodiment of the present invention is assembled on a flange in the section taken along S1-S1 of FIG. 13.
Figure 16:
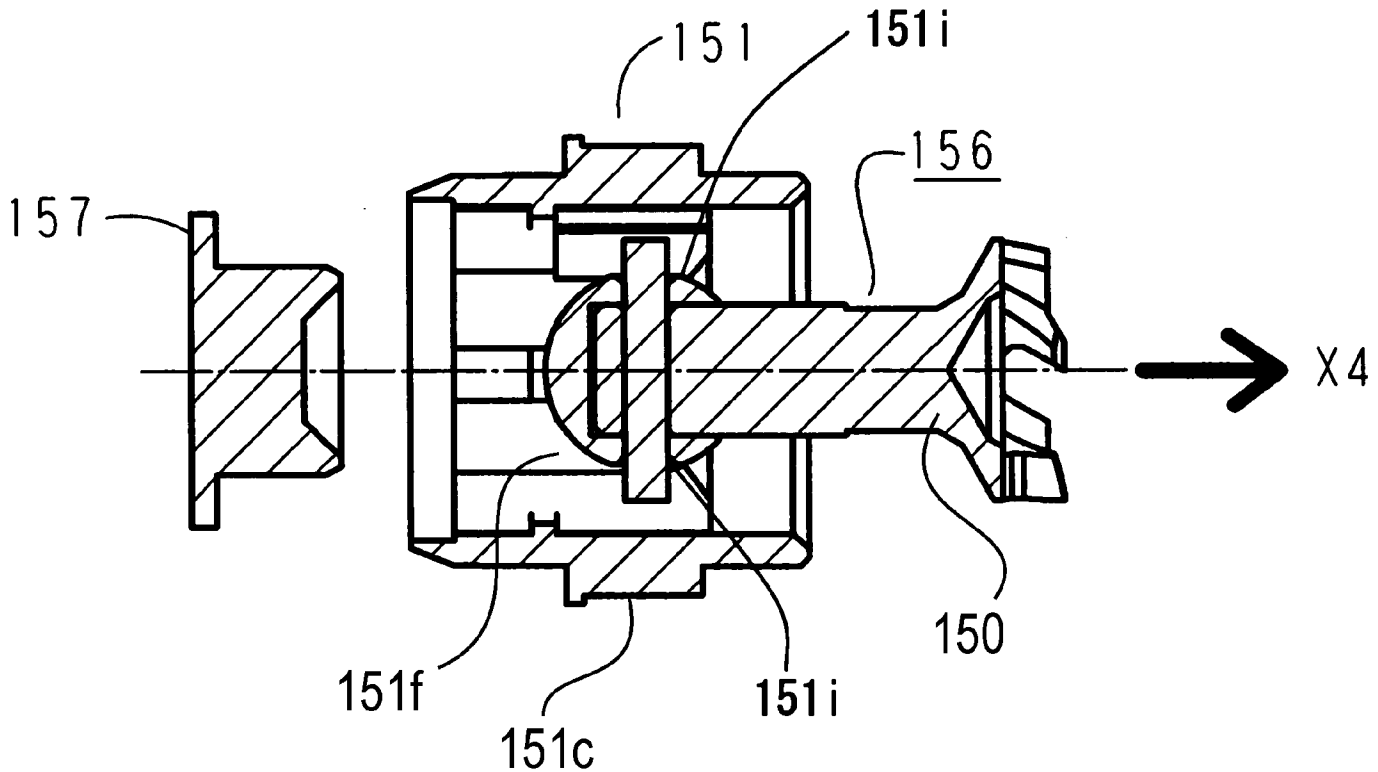
FIG. 16 is a sectional view which illustrates a process in which a coupling assembly according to the embodiment of the present invention is fixed on a flange in the section taken along S1-S1 of FIG. 13.

Referring to FIG. 15 and FIG. 16, the process in which the coupling 150 is fixed to the flange 151 will be described. FIG. 15 is a sectional view which illustrates the process in which the coupling 150 is assembled into the flange 151 in a section taken along the line S1-S1 of FIG. 13. FIG. 16 is a sectional view which illustrates the process in which the coupling 150 is fixed to the flange 151 in the section taken along the line S1-S1 of FIG. 13.

1. The end 150 of the coupling 150*s* is inserted in the direction of an arrow X1 into the flange 151.

2. Subsequently, the spherical member 160 is capped in a direction of the arrow X2.

3. In addition, the through-hole 160 of the spherical member 160*b* and the through-hole 150*r* of the end 150*s* are co-axially aligned, and thereafter, the pin 155 is inserted in the direction of an arrow X3.

4. The pin 155 penetrates the through-hole 160*b* and the through-hole 150*r*.

An inner diameter of the through-hole 160*b* is smaller than an outer diameter of the pin 155, and therefore, a frictional force is produced between the pin 155 and the through-hole 160*b* (press-fit).

By this, the coupling assembly 156 is assembled, and is disposed in a retainer 151*i* of drum flange 151. Furthermore, the coupling assembly 156 is moved in an X4 direction, and the spherical member 160 is contacted or approached to the retaining portion 151*i*.

Then, a retaining member 157 is inserted in a direction of the arrow X4 to be fixed to the flange 151. In this state, a play (gap) is provided between the recess 151*f* and the spherical member 160, and therefore, the coupling 150 is deflectable.

<Structure of Photosensitive Drum Unit>

Figure 17:
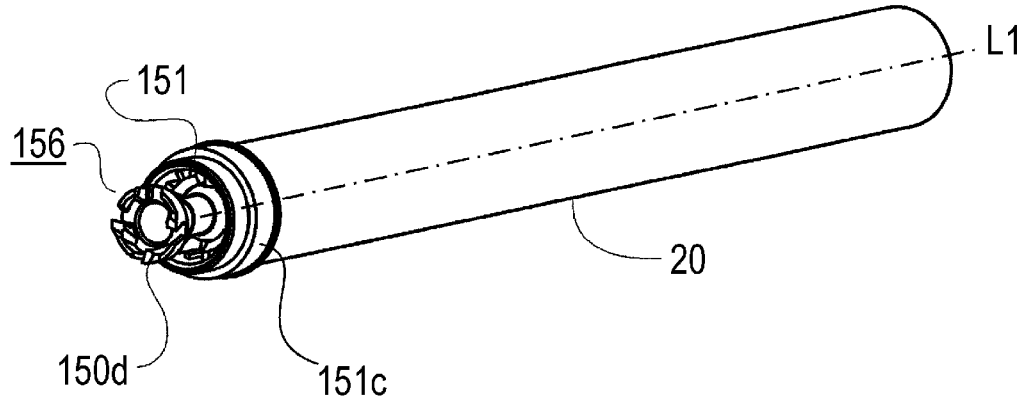
FIG. 17 is a perspective view of a photosensitive drum unit according to the embodiment of the present invention, as seen from a driving side (coupling member).
Figure 18:
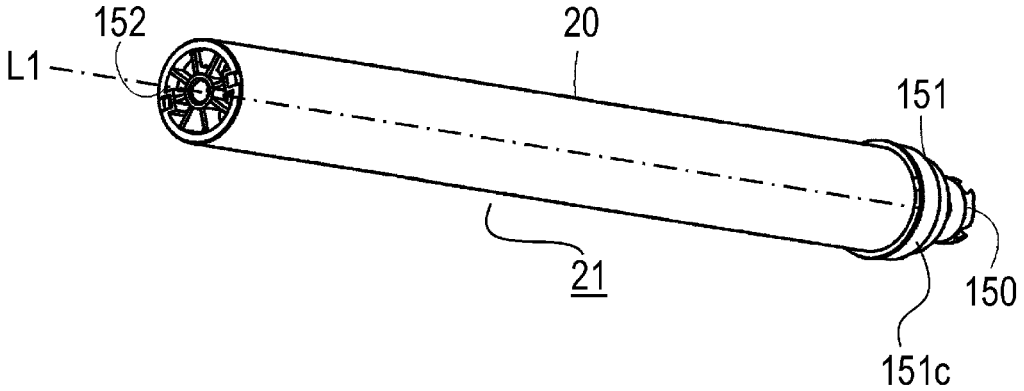
FIG. 18 is a perspective view of a photosensitive drum unit according to the embodiment of the present invention, as seen from a non-driving side.

Referring to FIG. 17 and FIG. 18, the structure of the photosensitive drum unit 21 will be described. FIG. 17 is a perspective view of the photosensitive drum unit 21, as seen from the driving side (coupling 150). FIG. 18 is a perspective view of the photosensitive drum unit 21, as seen from the non-driving side.

The flange 151 which is provided with the coupling assembly 156 is fixed to the one end portion of the photosensitive drum 20 so that the drive receiving projection 150*d* is exposed. A non-driving side drum flange 152 is fixed to the other end portion of the photosensitive drum 20. The fixing methods may be crimping, bonding, and welding or the like.

The photosensitive drum unit 21 is supported rotatably by the drum frame 51 (FIG. 3), in the state that the driving side is supported by a bearing member 158 (FIG. 3), and the non-driving side is supported by a photosensitive drum unit supporting pin 159 (unshown).

As has been described in the foregoing, the rotational force from the motor (unshown) of the main assembly 1 rotates the drive shaft 100 through the drive transmitting means (unshown) of a gear or the like of the main assembly 1. The rotational force is transmitted to the cartridge 2 through the coupling assembly 156.

Furthermore, it is transmitted from the coupling assembly 156 to the flange 151 through the pin 155, and then is transmitted to the flange 151 and the photosensitive drum 20 which are fixed integrally to rotate the photosensitive drum about an axis L1.

Furthermore, designated by 151*c* is a gear and transmits the rotational force received by the coupling 150 from the drive shaft 100 to the developing roller 41 (FIG. 2). The gear 151*c* is molded integrally with the flange 151.

<Cartridge Mounting Guide>

A mounting guide for mounting the cartridge 2 to the main assembly 1 will be described.

Figure 19:
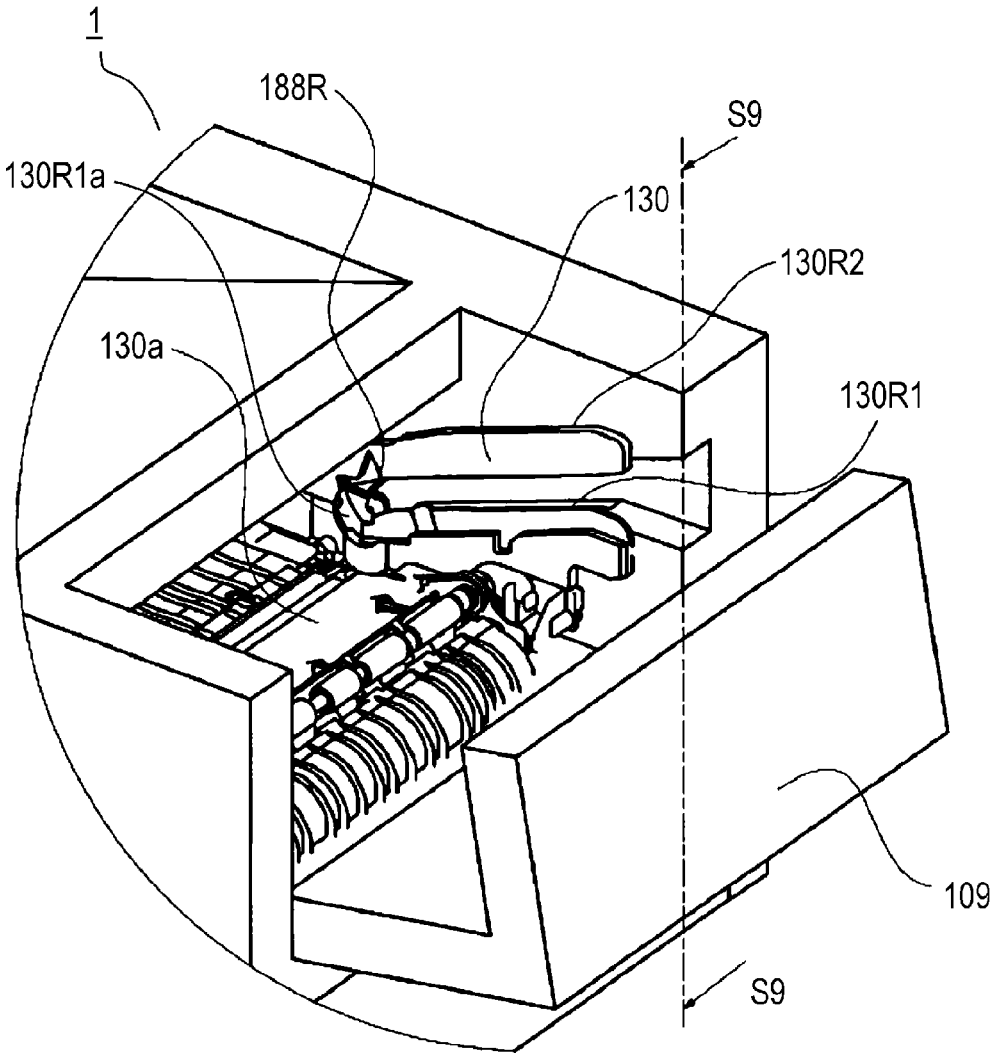
FIG. 19 is a perspective view of a cartridge set portion of the main assembly according to the embodiment of the present invention.
Figure 20:
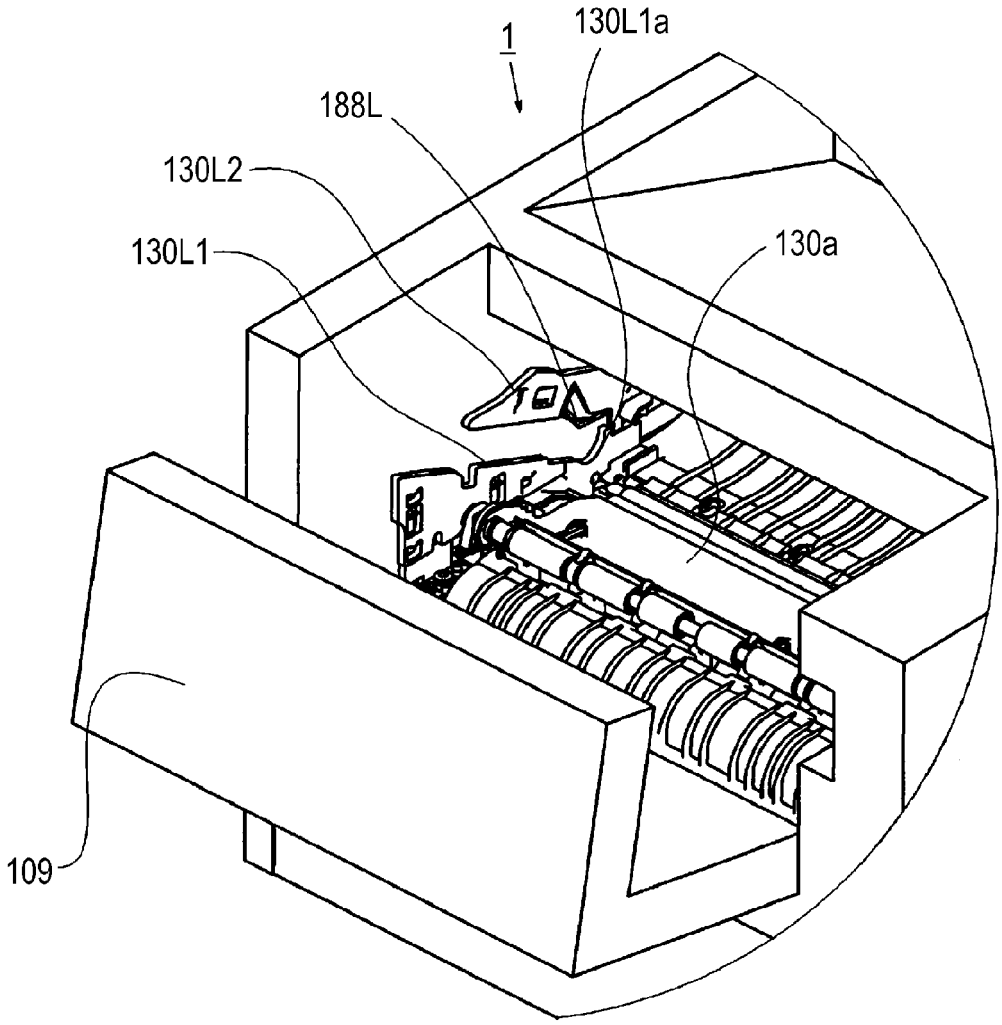
FIG. 20 is a perspective view of the cartridge set portion of the main assembly according to the embodiment of the present invention.

As shown in FIGS. 19 and 20, the mounting means 130 of this embodiment is provided with the main assembly guides 130R1, 130R2, 130L1, and 130L2 provided in the main assembly 1. They are opposed to the left and right side surfaces of a cartridge mounting spacing (cartridge set portion 130*a*]) provided in the main assembly 1 (FIG. 19 is a driving side view and FIG. 20 is a non-driving side view).

Opposing to the driving side of the cartridge 2, in a main assembly side, the main assembly guides 130R1 and 130R2 is provided along a mounting direction of the cartridge 2. On the other hand, opposing to the non-driving side of the cartridge 2, in the main assembly side, the main assembly guides 130L1 and 130L2 are provided along the mounting direction of the cartridge 2. The main assembly guides 130R1 and 130R2 and the main assembly guides 130L1 and 130L2 oppose to each other. In mounting the cartridge 2 to the main assembly 1*a* cartridge guide as will be described hereinafter is guided by the guides 130R1, 130R2, 130L1 and 130L2.

In order to mount the cartridge 2 to the main assembly 1, first, a cartridge door 109 openable and closable relative to the main assembly 1 is opened. By closing a door 109, the mounting of the cartridge 2 relative to the main assembly 1 is completed. In taking out the cartridge 2 from the main assembly 1, the door 109 is opened and the cartridge 2 is taken out. These operations are carried out by a user.

<Structure of Positioning Portion>

The mounting guide of the cartridge 2 and the positioning portion relative to the main assembly 1 will be described.

As shown in (a) of FIG. 3, and (b) of FIG. 3, in this embodiment, the outer periphery of an outside end of the bearing member 158 functions as a cartridge guide 140R1. A cylindrical portion of the drum frame functions as the cartridge guide 140L1.

The one longitudinal end portion (driving side) of the photosensitive member unit 50 is provided with the cartridge guide 140R2 substantially above the cartridge guide 140R1. The other longitudinal end portion (non-driving side) is provided with the cartridge guide 140L2 above the cartridge guide 140L1. More particularly, the one longitudinal end portion of the photosensitive drum 20 is provided with the cartridge side guides 140R1 and 140R2 outwardly project from the drum frame 51. The other longitudinal end portion is provided with the cartridge guide 140L1 and 140L2 outwardly projecting from the drum frame 51.

The guides 140R1, 140R2, 140L1 and 140L2 outwardly projects along the longitudinal direction. More particularly, the guides 140R1, 140R2, 140L1 and 140L2 project from the drum frame 51 along a drum axis L1. In mounting the cartridge 2 to the main assembly 1, and, in dismounting the cartridge 2 from the main assembly 1, the guide 140R1 is guided by the guide 130R1, and the guide 140R2 is guided by the guide 130R2. In mounting the cartridge 2 to the main assembly 1, and, in dismounting the cartridge 2 from the main assembly 1 the guide 140L1 is guided by the guide 130L1, and the guide 140L2 is guided by the guide 130L2.

In this manner, the cartridge 2 is moved in the direction (in this embodiment, substantially Orthogonal) crossing with an axial direction L3 of the drive shaft 100 to the main assembly 1 to be attached, and it is dismounted from the main assembly 1. In this embodiment, the cartridge guide 140R1 and 140R2 are molded integrally with the drum frame 51. However, the cartridge guide and others 140R1 and 140R2 may be separate members.

Here, the substantial perpendicularity will be described. Between the cartridge 2 and the main assembly 1, a small gap is provided in order to mount and demount the cartridge 2 smoothly. More specifically, the small gaps are provided between the guide 140R1 and the guide 130R1, between the guide 140R2 and the guide 130R2, between the guide 140L1 and the guide 130L1 and between the guide 140L2 and the guide 130L2 with respect to the longitudinal direction. Therefore, in dismounting and mounting the cartridge 2 relative to the main assembly 1, a whole cartridge 2 may slightly be oblique within the range of the gaps. Therefore, the dismounting and mounting directions may not be the orthogonal directions strictly. However, even in such a case, the functional effects of this embodiment are accomplished. Therefore, also in the case where the cartridge is slightly oblique, they are orthogonal substantially.

<Mounting and Demounting Operation of Cartridge>

Figure 21:
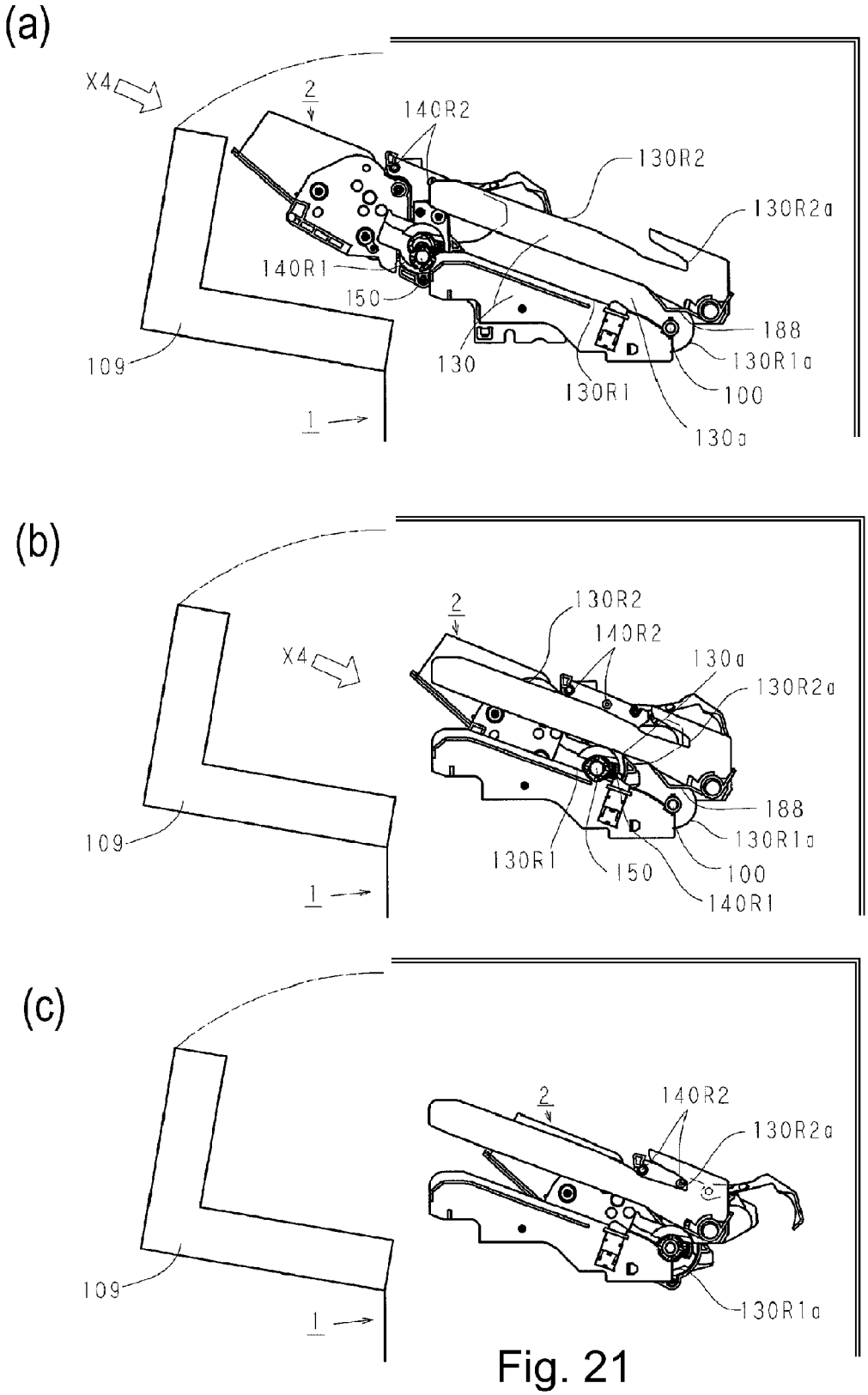
FIG. 21 is a sectional view illustrating the process in which a cartridge is mounted to the main assembly according to the embodiment of the present invention.

Referring to FIG. 21, mounting operation, relative to (main assembly 1, of the cartridge 2 will be described. FIG. 21 shows a mounting process, and is a sectional view taken along line S9-S9 in FIG. 19.

As shown in (a) of FIG. 21, the user opens the door 109. The cartridge 2 is dismountably mounted to cartridge mounting means 130 (a set portion 130*a*) provided in the main assembly 1.

As shown in (b) of FIG. 21, in mounting the cartridge 2 to the main assembly 1, it is inserted so that the cartridge guides 140R1140R2 move along the main assembly guides 130R1 and 130R2 in the driving side. In the non-driving side, the cartridge guides 140L1 and 140L2 ((b) of FIG. 3) is moved along the main assembly guides 130L1 and 130L2 (FIG. 20).

As the cartridge 2 is inserted in the direction of the arrow X4, the cartridge 2 is mounted to the predetermined position (set portion 130*a*) (It is set there) through the coupling engagement between the drive shaft 100 and the cartridge 2. As shown in (c) of FIG. 21, and FIG. 19, that is, the cartridge guide 140R1 contacts to the positioning portion 130R1*a* of the main assembly guide 130R1, and the cartridge guide 140R2 contacts to the positioning portion 130R2*a* of the main assembly guide 130R2. The cartridge guide 140L1 contacts to the positioning portion 130L1 of the main assembly guide 130L1*a* (FIG. 20), and the cartridge guide 140L2 contacts to the positioning portion 130L2 of the main assembly guide 130L2*a* (unshown). The positioning portion 130L2*a* of the main assembly guide 130L2 is omitted in the Figure, since it is substantially symmetrical with the positioning portion 130R2*a* of the main assembly guide 130R2.

In this manner, the cartridge 2 is dismountably mounted by the mounting means 130 to the set portion 130*a*. More particularly, the cartridge 2 is mounted and positioned to the main assembly 1. In the state that the cartridge 2 is mounted to the set portion 130*a*, the drive shaft 100 and the coupling assembly 156 are in engagement with each other. More particularly, the coupling assembly 156 is in a rotational force transmitting angular position as will be described hereinafter.

By the cartridge 2 being mounted to the set portion 130*a*, an image forming operation is enabled. When the cartridge 2 is stored in the predetermined position described above, an urging spring 188R (FIG. 19) presses the cartridge guide 140R1 of the cartridge 2. The urging spring 188L (FIG. 20) presses the cartridge guide 140L1 of the cartridge 2. By this, the cartridge 2 (photosensitive drum 20) is accurately positioned relative to the transfer roller, optical means or the like of the main assembly 1.

Figure 23:
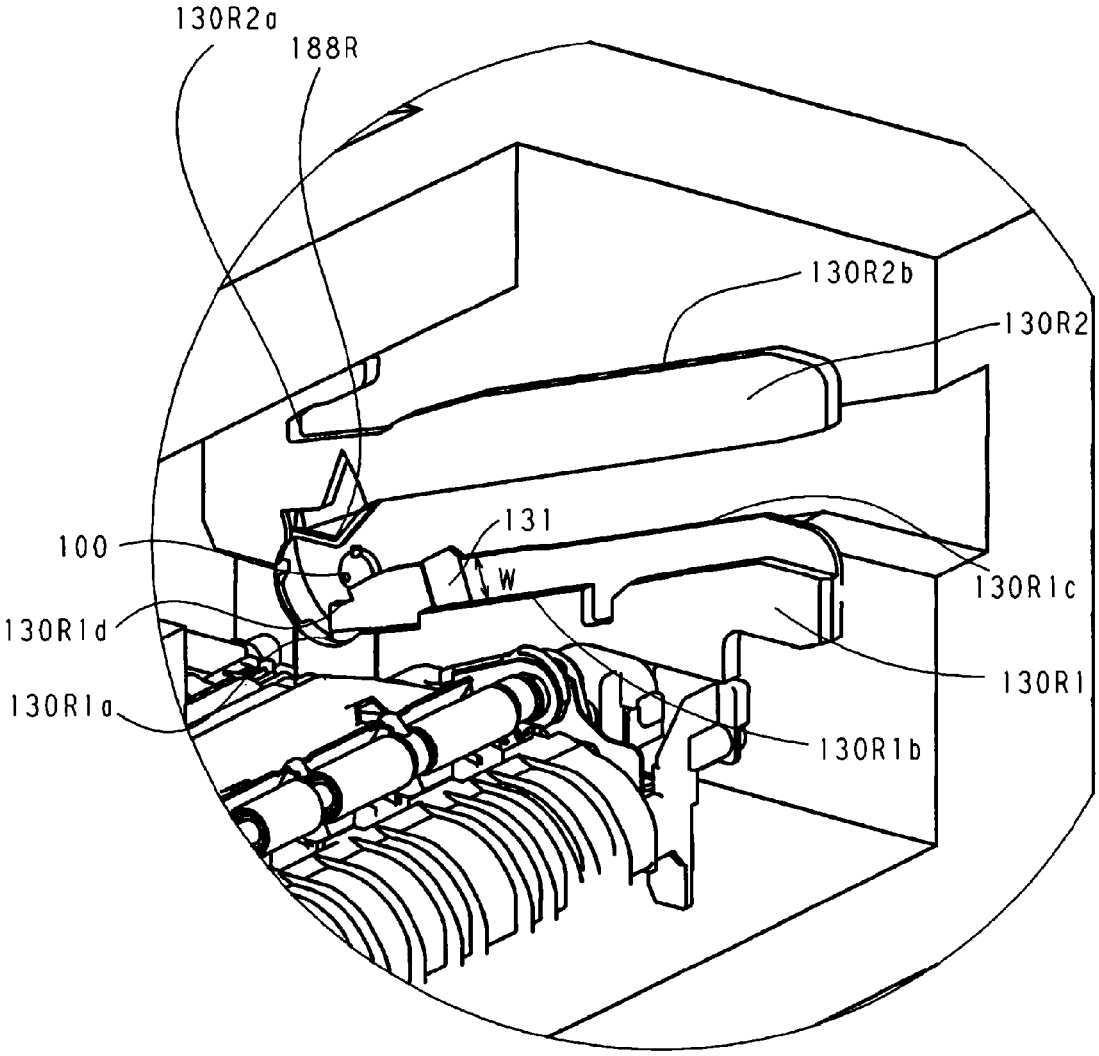
FIG. 23 is a perspective view illustrating a driving side of a main assembly guide according to the embodiment of the present invention.

Referring to FIG. 23 the main assembly guide and coupling urging means will be described. FIG. 23 is a perspective view illustrating the driving side of the main assembly.

In the image forming apparatus of this embodiment, the coupling can be assuredly pivoted to a mounting-and-dismounting angular position by the connecting portion or the main assembly guide rubbing it, for example, even if the frictional force increases. The main assembly guide 130R1 is provided with a guiding surface 130R1*b* for guiding the cartridge 2 mainly through the cartridge guide 140R1 (FIG. 3), a guide rib 130 for guiding the coupling 150R1*c*, and a cartridge positioning portion 130R1*a*. The guide rib 130R1*c* is on the mounting locus of the cartridge 2. The guide rib 130R1*c* is extended to the front side of the drive shaft 100 in a cartridge mounting direction. A rib 130R1*d* provided on the neighborhood of the drive shaft 100 has such a height that when it engages with the coupling 150, no interference occurs.

Figure 24:
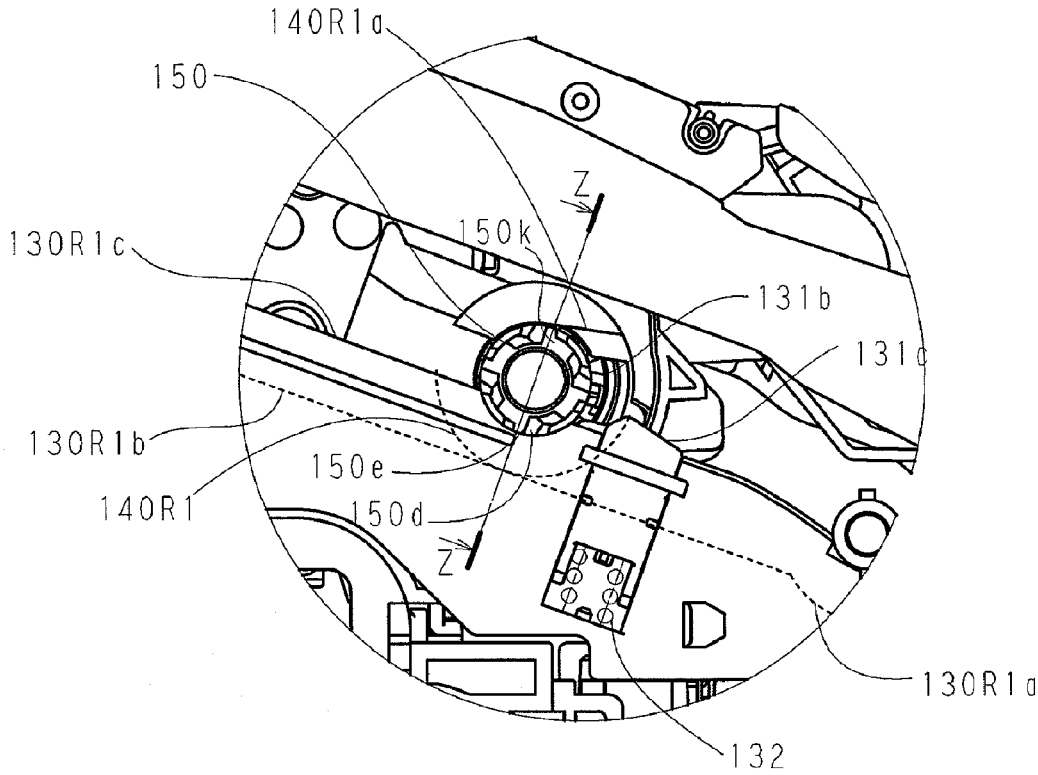
FIG. 24 is a side view illustrating a relation between the main assembly guide and the coupling member according to the embodiment of the present invention.

A part of the rib is 130R1*c* cut away. To the rib 130R1*c*, a main assembly guide slider 131 which is the inclining means for inclining the coupling assembly 156 toward a mounting direction when the cartridge 2 is mounted to the main assembly, and is mounted slidably in the direction of an arrow W. The slider 131 is pressed by an elastic force of the urging spring 132 (FIG. 24). In this state, the slider 131 is projected beyond the guide rib 130R1*c*.

The main assembly guide 130R2 is provided with a guide portion 130R2*b* for guiding a part of the drum frame 51 and for mainly determining an orientation at the time of a mounting of the cartridge 2 and the cartridge positioning portion 130R2*a*.

Figure 25:
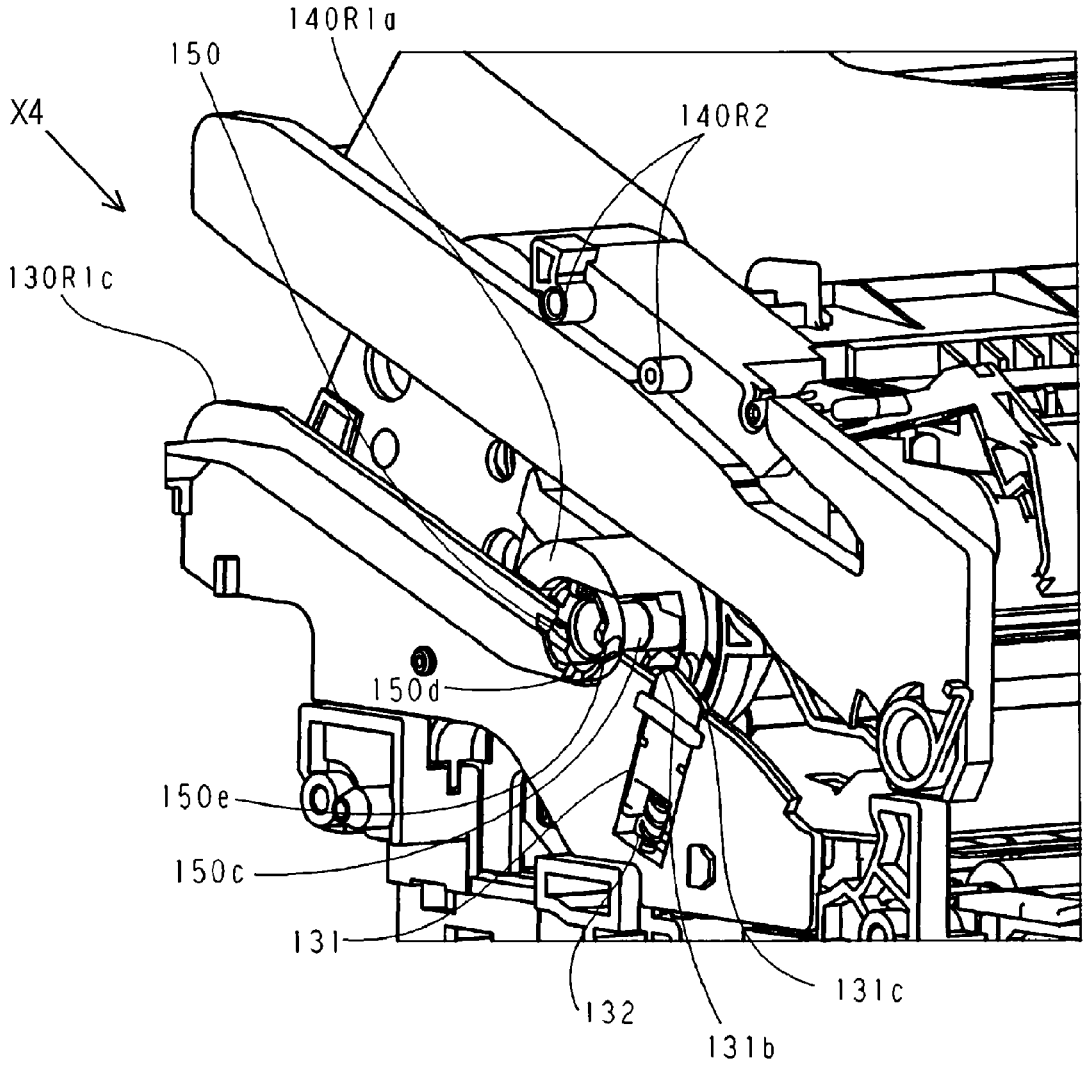
FIG. 25 is a perspective view illustrating the relation between the main assembly guide and the coupling member according to the embodiment of the present invention.
Figure 26:
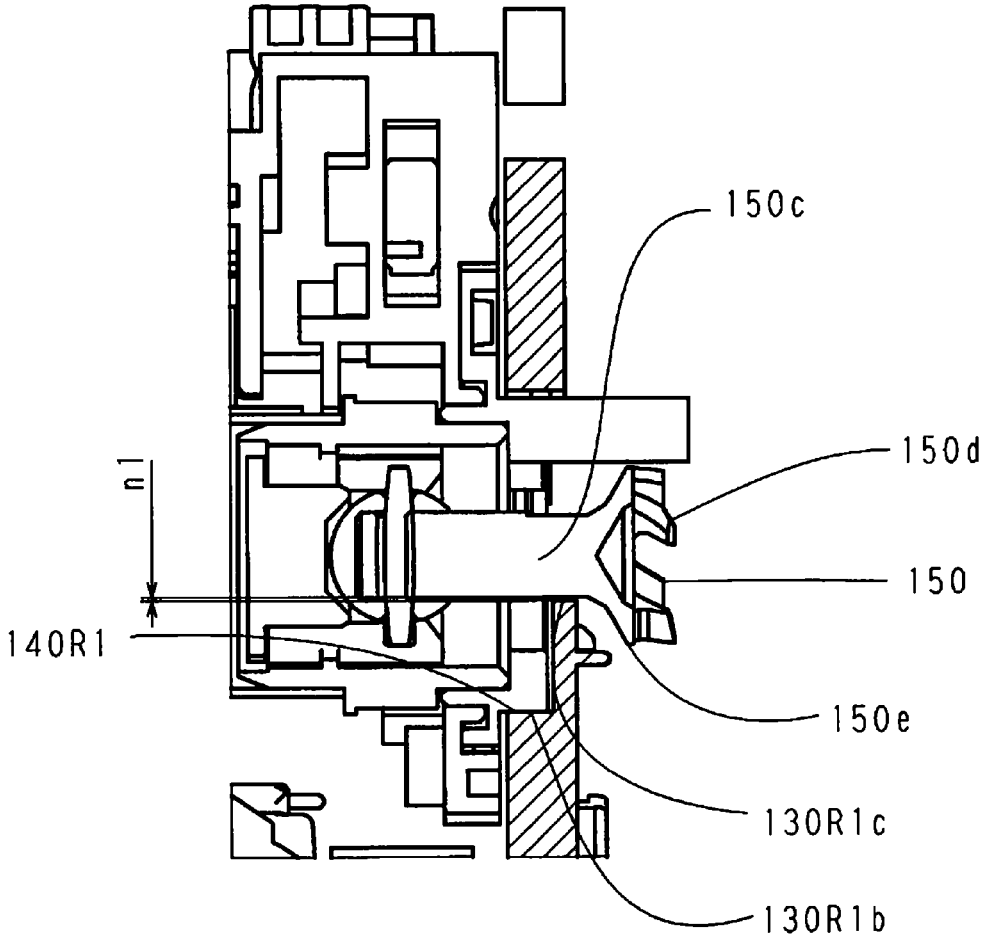
FIG. 26 is a side view illustrating the relation between the cartridge and the main assembly guide according to the embodiment of the present invention.

Referring to FIG. 24-FIG. 26, the relation among the main assembly guides 130R1 and 130R2, the slider 131, and the cartridge 2 during mounting operation of the cartridge 2 will be described. FIG. 24 is a side view, as seen from a main assembly driving shaft 100 (FIG. 19) side, and is a perspective view of FIG. 25. FIG. 26 is a sectional view taken along the line Z-Z of FIG. 24.

As shown in FIG. 24, the cartridge 2 is moved in the state that the cartridge guide 140R1 contacts to the guiding surface 130R1*b* in the driving side. As shown in FIG. 26, at this time, the connecting portion 150*c* is spaced by a distance n1 from the guide rib 130R1*c*. For this reason, no force is applied to the coupling 150. As shown in FIG. 24, the coupling 150 is regulated by the regulating portion 140R1*a* in the range to the left side from the upper surface. For this reason, the coupling 150 can freely be inclined only in the mounting direction (X4).

Figure 27:
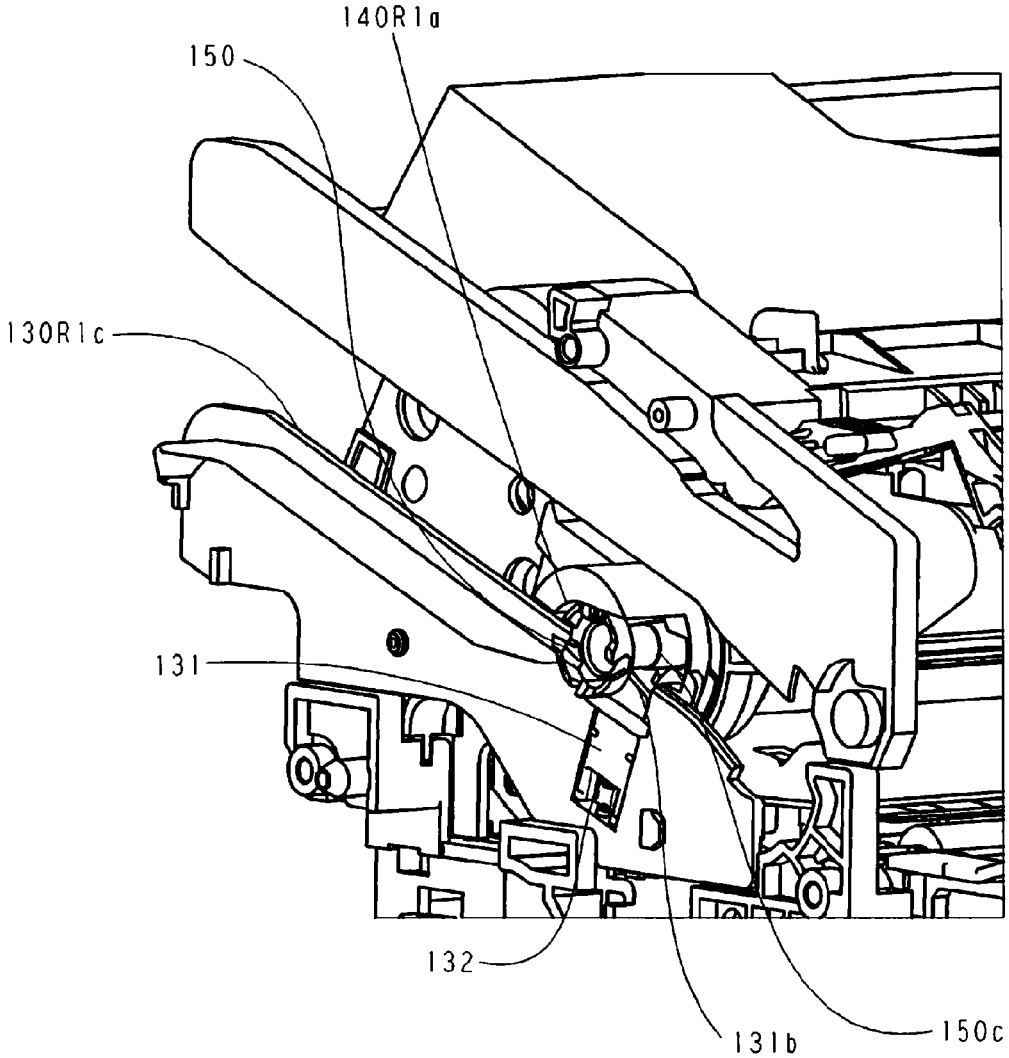
FIG. 27 is a perspective view illustrating the relation between the main assembly guide and the coupling member according to the embodiment of the present invention.
Figure 28:
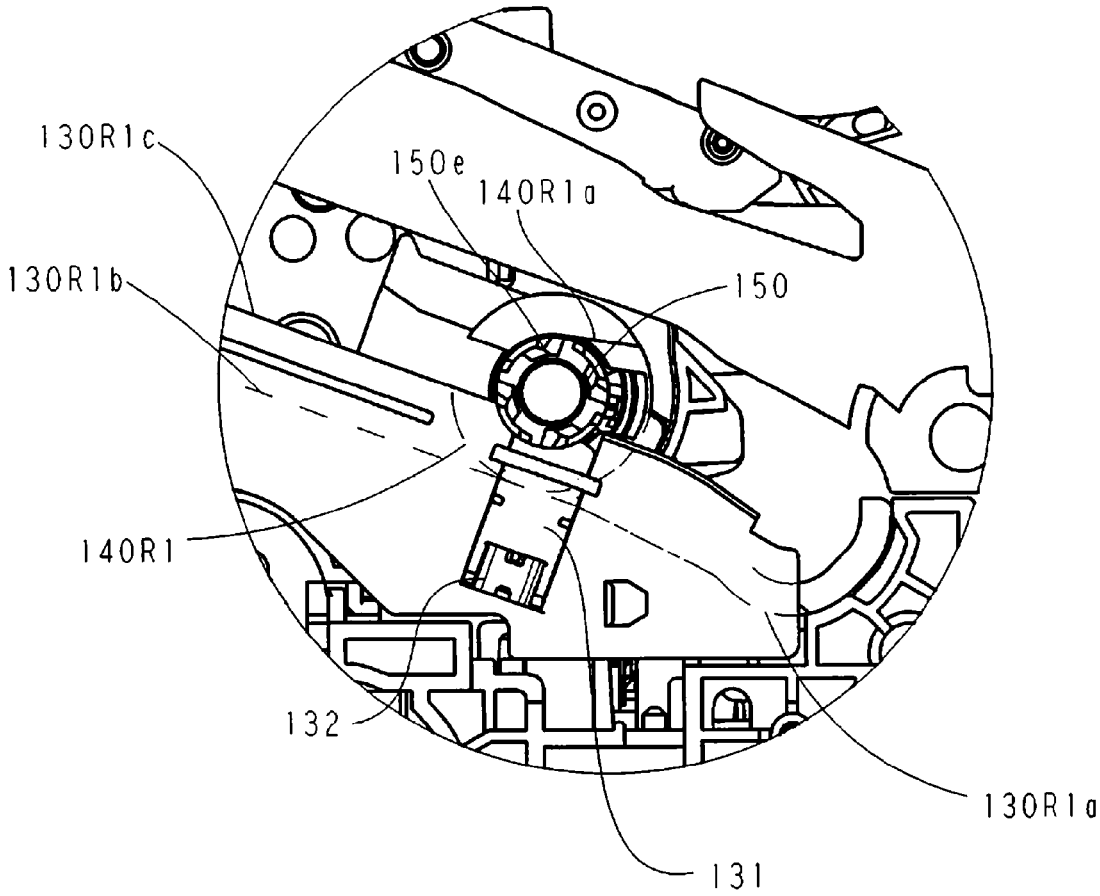
FIG. 28 is a side view illustrating the relation between the main assembly guide and the coupling member according to the embodiment of the present invention.

Referring to FIGS. 27 and 28, the description will be made as to the operation of the slider 131 moved to a retracted position from an urging position while the coupling 150 contacts to the slider 131. FIGS. 27 and 28 show the state that the coupling 150 to an apex 131 of the slider 131*b*, more particularly, the state that the slider 131 moves to the retracted position. By the entrance of the coupling 150 pivotable to the mounting direction (X4) only, the connecting portion 150*c* contacts to the upstream side inclined surface 131*a* of the projection of the slider 131 (FIG. 29) with respect to the cartridge mounting direction. By this, the slider 131 is depressed and is moved to the retracted position.

Figure 29:
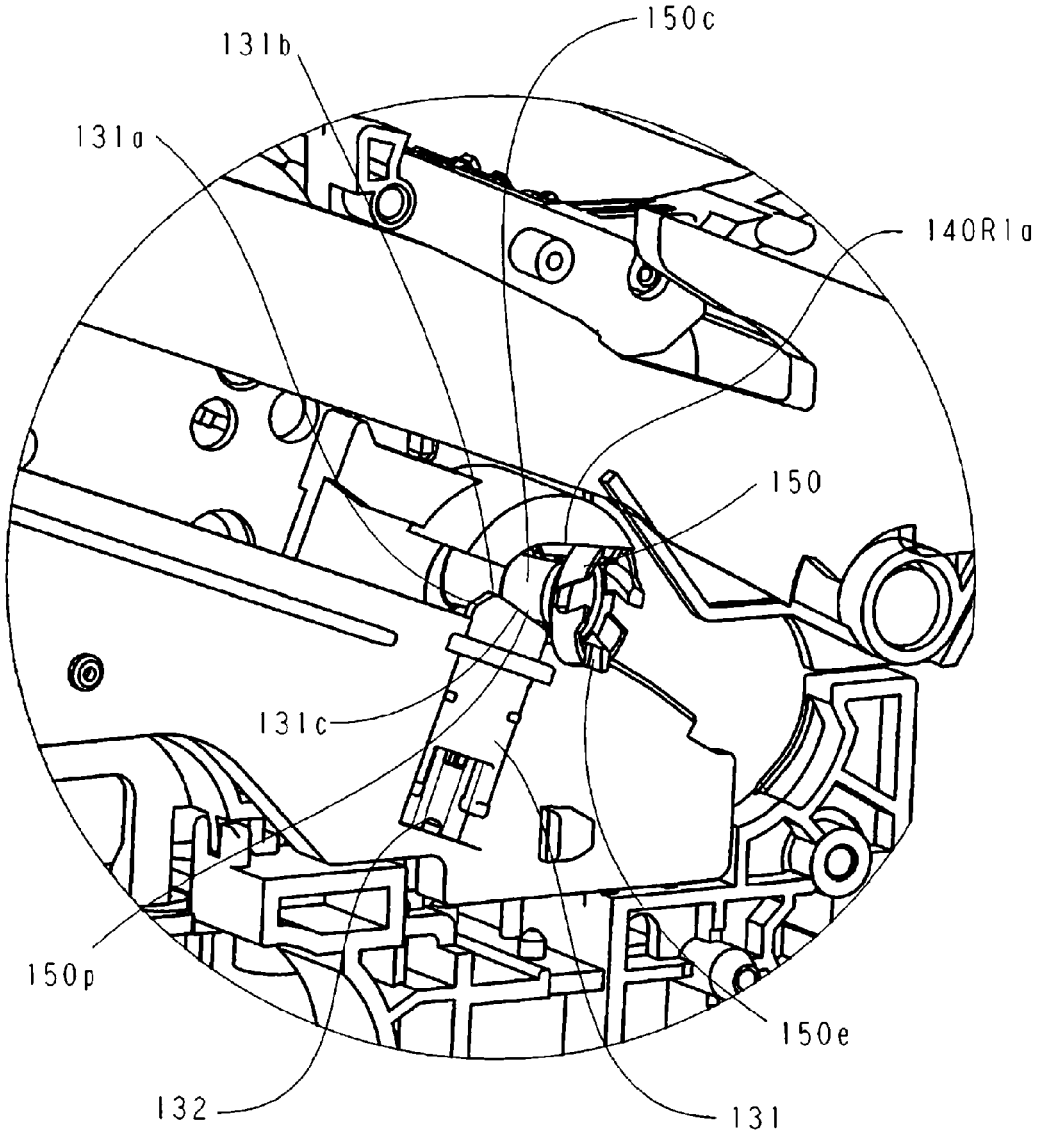
FIG. 29 is a perspective view illustrating the relation between the main assembly guide and the coupling member according to the embodiment of the present invention.
Figure 30:
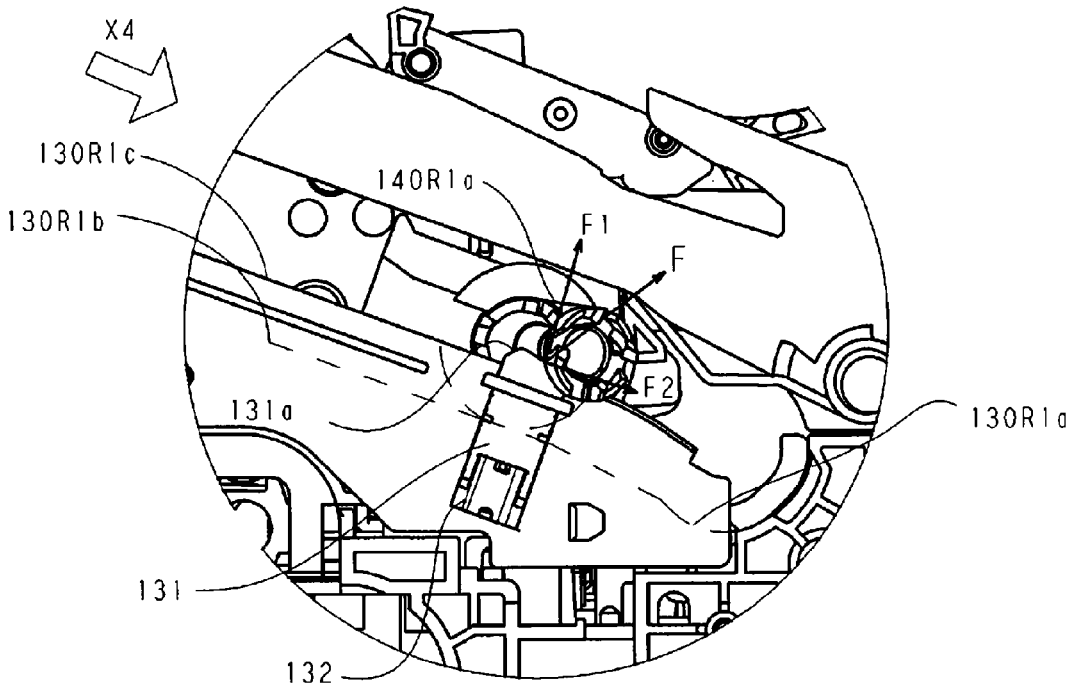
FIG. 30 is a side view illustrating the relation between the main assembly guide and the coupling member according to the embodiment of the present invention.

Referring to FIGS. 29 and 30, the description will be made as to the operation after the coupling 150 rides over the apex 131 of the slider 131*b*. FIGS. 29 and 30 show the state after the coupling 150 rides over the apex 131 of the slider 131*b*.

When the coupling 150 rides over the apex 131*b*, the slider 131 tends to return from the retracted position to the urging position by the elastic force of the urging spring 132. In that case, a part of connecting portion 150 of the coupling 150*c* receives a force F from the downstream side inclined surface 131 of the slider 131*c*. More particularly, the inclined surface 131*c* functions as a force applying portion so that a part of connecting portion 150*c* functions as a force receiving portion 150 for receiving the force p.

Figure 22:
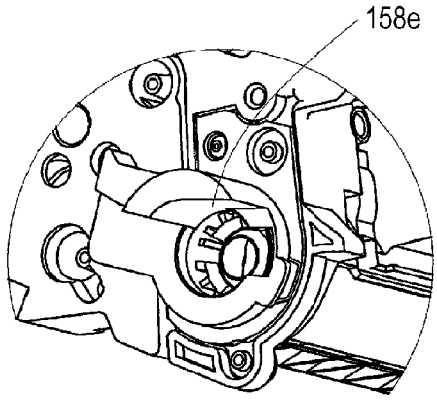
FIG. 22 is a sectional view illustrating a drum bearing according to the embodiment of the present invention.
Figure 22:
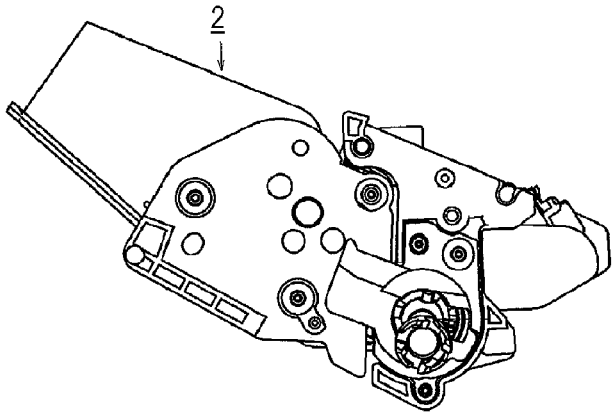
Figure 22:
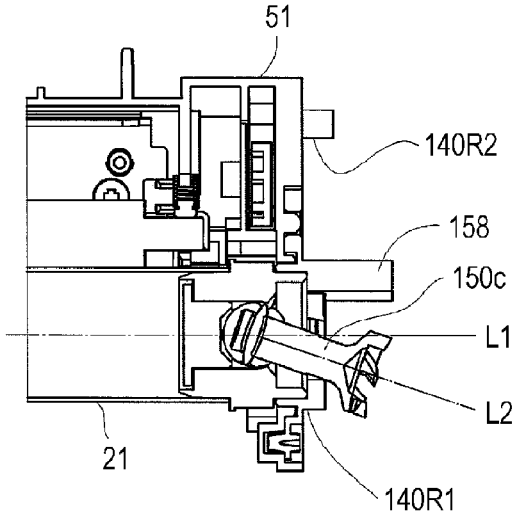

As shown in FIG. 29, the force receiving portion 150, p is provided in the upstream side, with respect to the cartridge mounting direction, of the connecting portion 150*c*. For this reason, the coupling 150 inclines smoothly. As shown in FIG. 30, the force F is divided into the component forces F1 and F2. At this time, the upper surface of the coupling 150 is limited by the regulating portion 140R1*a*. A part of regulating portion 140R1*a* is provided with a flat surface portion 158*e* ((a) of FIG. 22), which is substantially parallel to a cartridge mounting direction X4 or which is inclined with a small angle. For this reason, the coupling 150 results in inclining toward the mounting direction (X4) by the component force F2. More particularly, the coupling 150 is inclined toward the mounting-and-dismounting angular position. By this, the coupling 150 becomes in the state engageable with the drive shaft 100.

In this embodiment, the connecting portion 150*c* receives the force to incline the coupling 150. However, this is not inevitable. It will suffice if the coupling 150 is inclinable by receiving the force from the slider 131 of the main assembly, for example, in the case where the position other than the connecting portion 150*c* contacts with the slider 131.

Figure 31:
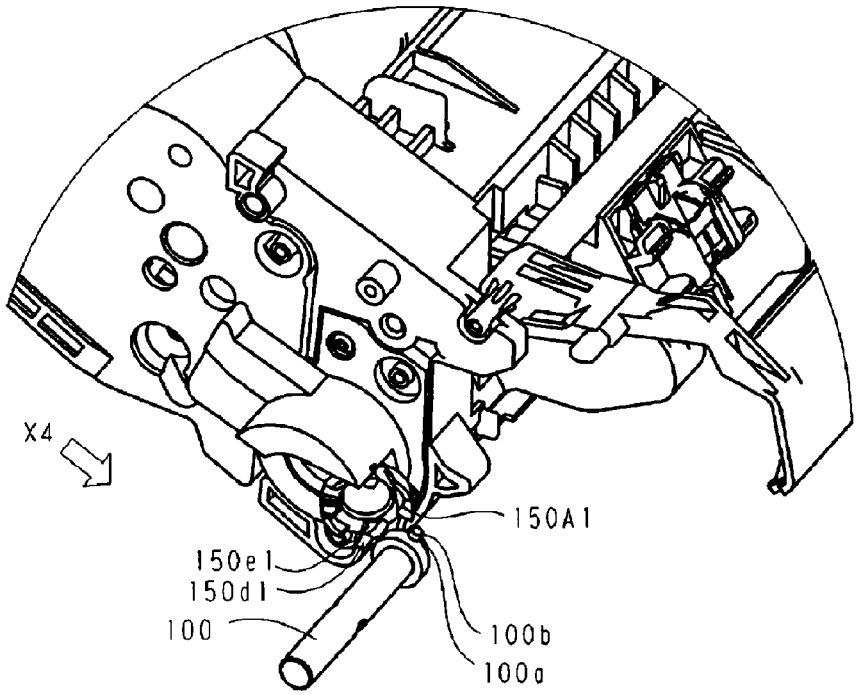
FIG. 31 is a perspective view illustrating the process in which the drive shaft and the coupling member according to the embodiment of the present invention engage with each other.
Figure 31:
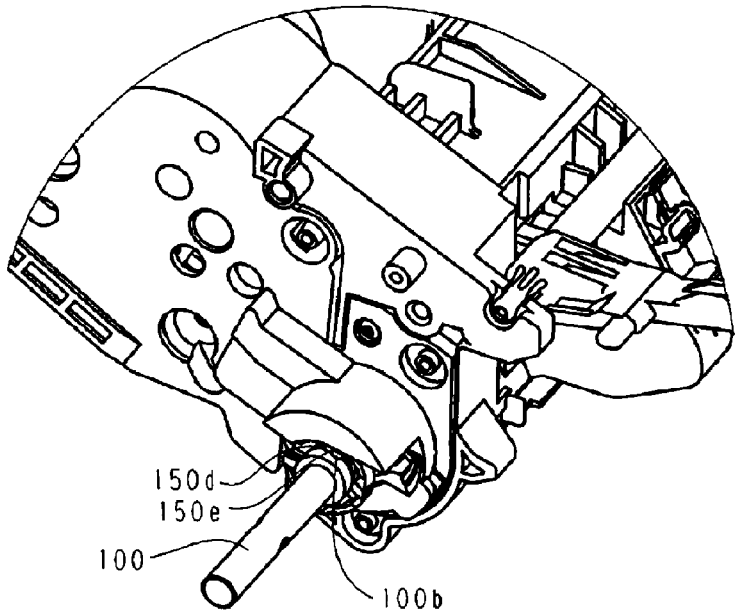
Figure 32:
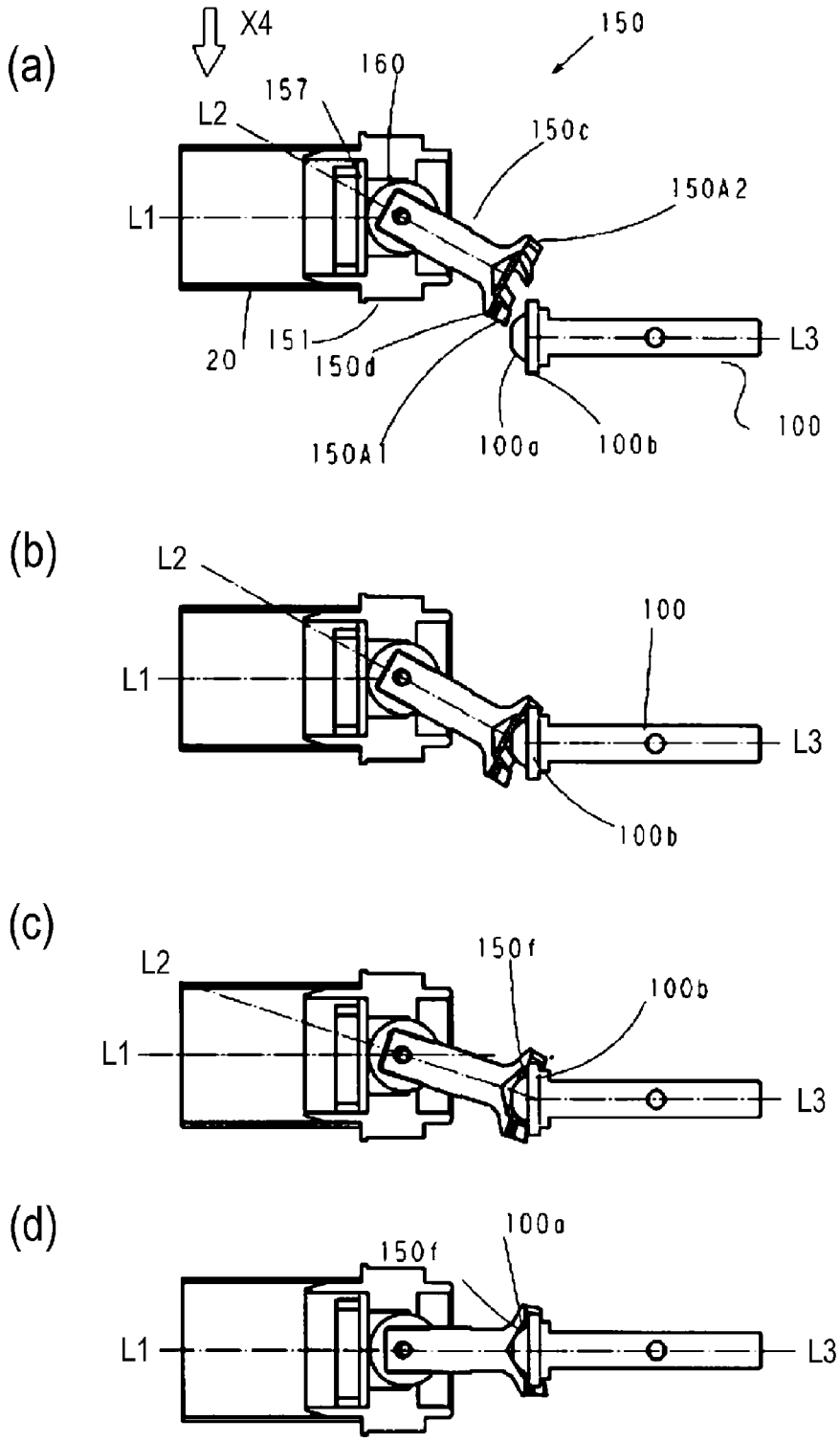
FIG. 32 is a perspective view illustrating the process in which the coupling member is mounted to the drive shaft according to the embodiment of the present invention.

The engaging operation and the drive transmission of the coupling will be described. The coupling 150 of the cartridge 2 engages with the drive shaft 100 immediately before it is determined to the predetermined position in the main assembly 1, or at the same time it is determined at the predetermined position. Referring to FIGS. 31 and 32 the description will be made as to an engaging operation of the coupling 150. FIG. 31 is a perspective view illustrating a major part of the driving side of the drive shaft 100 and the cartridge. FIG. 32 is a longitudinal sectional view, as seen from the lower part of the main assembly.

As shown in FIG. 32, in the mounting process of the cartridge 2, the cartridge 2 is mounted to the main assembly 1 in the direction (direction of the arrow X4) substantially perpendicular to the axis L3 of the drive shaft 100. At this time as has been described hereinbefore, an axis, L2 of the coupling 150 has inclined toward the downstream side with respect to the mounting direction relative to the drum axis L1, beforehand (mounting-and-dismounting angular position) ((a) of FIG. 31, (a) of FIG. 32).

Here, the mounting-and-dismounting angular position of the coupling 150 is the angular position relative to the axis L1 of the coupling 150 immediately before the coupling 150 engages with the drive shaft 100 in mounting the cartridge 2 to the main assembly 1. More particularly, it is such an angular position relative to the axis L1 that the downstream side free end portion 150A1 of the coupling 150 can pass by the drive shaft 100 in an inserting direction of the cartridge 2.

By an inclination of the coupling 150, a free end position 150A1 in the downstream side with respect to the inserting direction is nearer than the free end portion 100*a* of the drive shaft to the photosensitive drum 20 in the direction of the drum axis L1. The upstream free end position 150A2 is nearer than the free end portion 100*a* of the drive shaft at the pin 100*b* ((a) of FIG. 32).

First, the downstream free end position 150A1 passes by the free end portion 100 of the drive shaft a. Thereafter, a conical driving shaft receiving surface 150*f* or the drive receiving projection 150*d* contacts to the free end portion 100 of the drive shaft 100*a* or the rotational force drive transmission pin 100*b*. Here, a receiving surface 150*f* and/or a projection 150*d* is a cartridge side contact portion. The free end portion 100 of the drive shaft and/or the pin 100*b* is a main assembly side engaging portion.

In response to a movement of the cartridge 2, the coupling 150 is inclined ((c) of FIG. 32), so that a coupling axis L2 becomes substantially aligned with the drum axis L1. When the position of the cartridge 2 is finally determined relative to the main assembly 1, the drive shaft 100 and the photosensitive drum 20 are substantially co-axial with each other ((c) of FIG. 32). More particularly, the coupling 150 is substantially pivoted to the rotational force transmitting angular position from the mounting-and-dismounting angular position in the state that the cartridge side contact portion is in contact with the main assembly side engaging portion, in response to the pushing of the cartridge 2 toward the backside of the main assembly 1, so that the coupling axis L2 is substantially on the same line as the drum axis L1. The coupling 150 and the drive shaft 100 are engaged with each other ((b) of FIG. 31, (c) of FIG. 32).

As has been described in the foregoing, the coupling 150 is inclinable relative to the drum axis L1. In response to the mounting operation of the cartridge 2, it can be engaged with the drive shaft 100 by the pivoting of the coupling 150.

The engaging operation of the coupling 150 described above is capable regardless of the phases of the drive shaft 100 and the coupling 150. In this manner, in this embodiment, the coupling 150 is mounted such that it can revolve, swing, pivot or whirl about the axis L1 of the drum. A motion of the coupling shown in FIG. 32 may be included in the revolution.

<Structures of Coupling Assembly and Pin>

Figure 33:
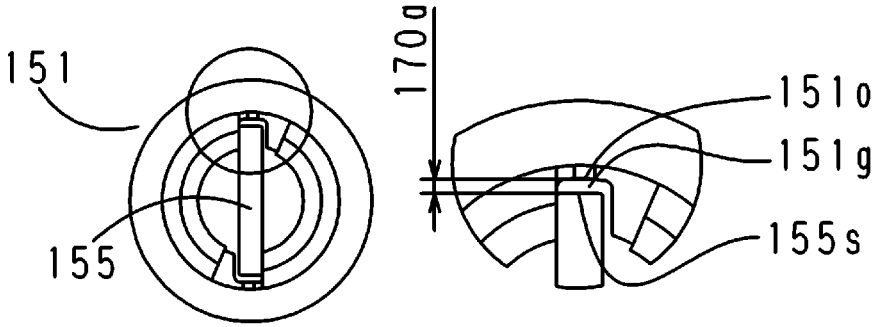
FIG. 33 is a view of the drum flange, a pin and a gap according to the embodiment of the present invention, as seen from a rotational force receiving portion side.
Figure 34:
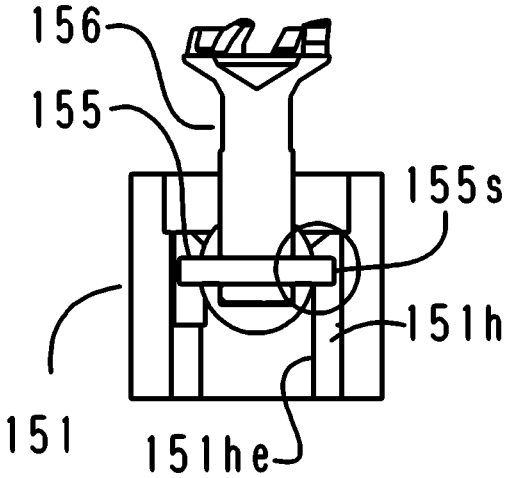
FIG. 34 is a sectional view illustrating the engagement depth between the drum flange and the coupling assembly according to the embodiment of the present invention.
Figure 34:
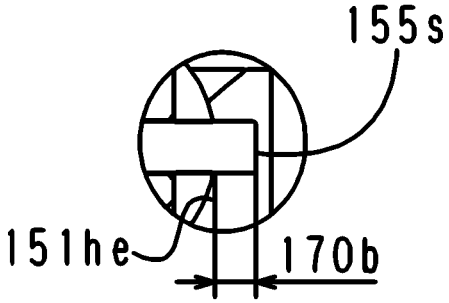
Figure 35:
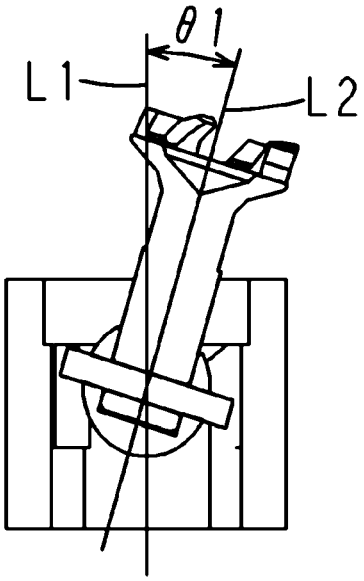
FIG. 35 is a sectional view illustrating angular positions of the coupling assembly and drum flange according to the embodiment of the present invention.

Referring to FIG. 33-FIG. 35 the description will be made the structures of the drum flange 151 and the coupling assembly 156 according to this embodiment.

FIG. 33 shows the drum flange 151 and is a view of the coupling assembly 156, as seen from the rotational force receiving portion 150 (*e*) side. Only the pin 155 of the coupling assembly 156 is illustrated in FIG. 33 for better illustration. FIG. 34 and FIG. 35 are a sectional views illustrating the drum flange 151 and the coupling assembly 156.

As shown in FIG. 33, when the coupling assembly 156 is in the rotational force transmitting angular position as will be described hereinafter, a pin regulating portion 151 provided in the opening portion 151*g* o forms the gap 170*a* relative to the free end portion 155 of the pin 155*s* in order to prevent interference between the drum flange 151 and the pin 155.

As shown in FIG. 34, the engagement depth 170 as will be described hereinafter b is provided between the pin 155 and the rotational force transmitted portion 151*h* provided on drum flange 151.

Here, the angular position is an inclination of the axis L2 of the coupling assembly 156 relative to the axis L1 of the drum flange 151 mounted to the photosensitive drum (unshown) as indicated by FIG. 35. The inclination of the left-right direction shows in FIG. 35, but, the inclination in the plane perpendicular to the sheet of the drawing of the Figure, and the inclination in a plane therebetween are the same.

Here, the rotational force transmitting angular position is the angular position for transmitting the rotational force in which the image formation is possible to the photosensitive drum, and in this angular position the angle of the axis L2 of the coupling assembly 156 relative to the axis L1 of drum flange 151 θ1 is small (0<=θ1<=5 degrees in this embodiment).

<Engagement Depth of Pin>

The description will be made as to the engagement depth 170*b* formed between the pin 155 and the rotational force transmitted portion 151*h* provided in drum flange 151.

Figure 36:
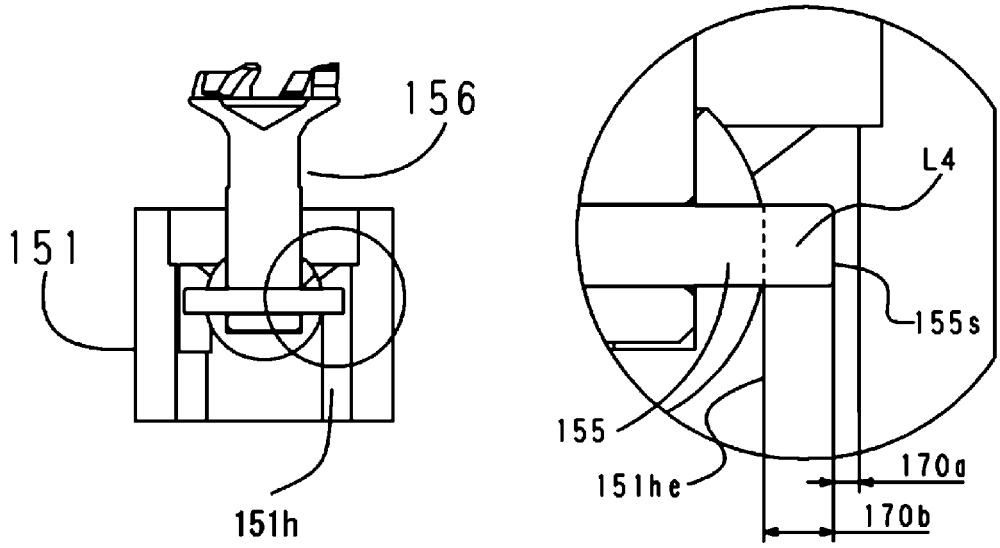
FIG. 36 is a sectional view illustrating the engagement depth in the embodiment of the present invention.
Figure 37:
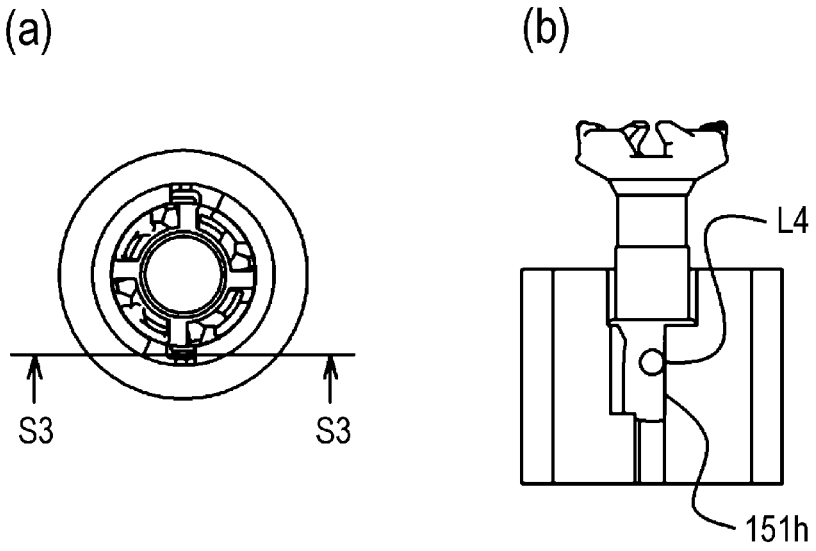
FIG. 37 is a sectional view illustrating the engagement depth in the embodiment of the present invention.
Figure 38:
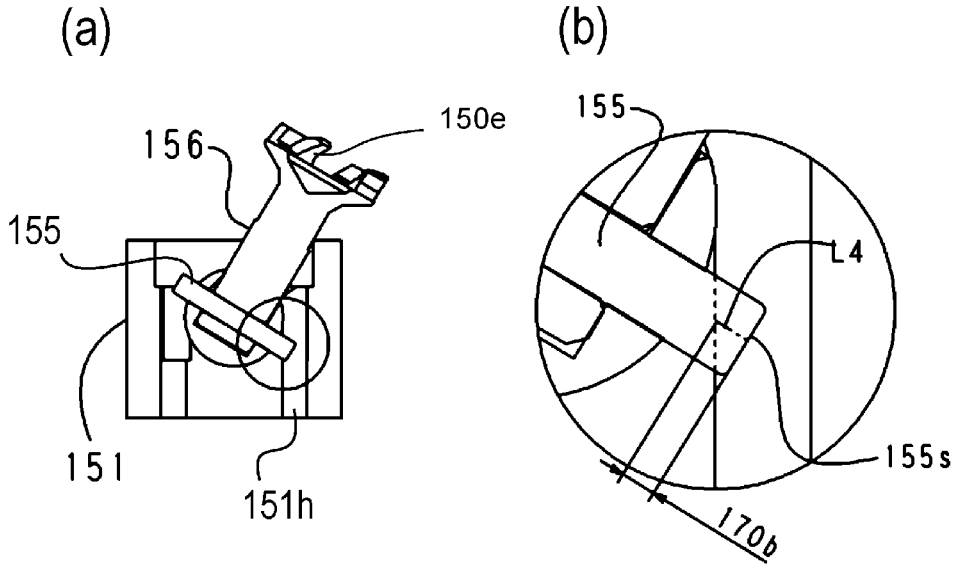
FIG. 38 is a sectional view illustrating the engagement depth in the embodiment of the present invention.

FIG. 36 is a sectional view and a detailed view for illustrating the engagement depth 170*b*, and it is a section of the drum flange 151 and the coupling assembly 156 taken along the line S1-S1 in FIG. 13. Part (a) of FIG. 37 is a view of the coupling assembly 156 and the drum flange 151 as seen toward the rotational force receiving portion 150*e*. FIG. 37 (*b*) is a sectional view taken along S3-S3 of FIG. 37 (*a*), and it is a sectional view of the pin 155 and the rotational force transmitted portion 151*h* as seen toward the free end of the pin 155. FIG. 38 is a sectional view and a detailed view illustrating the engagement depth when the coupling assembly 156 inclines.

The engagement depth 170*b* is the length of a region L4 in which the pin 155 and the rotational force transmitted portion 151*h* contacts to each other, and in this embodiment, it exists in the neighborhoods of opposite ends of the pin 155, as shown in FIGS. 36 and 37. FIGS. 36 and 37 show the engagement when the coupling assembly 156 is in the rotational force transmitting angular position and the engagement depth is depicted by 170*b*, and it exists also in the state that the coupling assembly 156 inclines as shown in FIG. 38.

Here, the description will be made as to the case, wherein when the coupling assembly 156 is in the rotational force transmitting angular position, and receives the drive transmission force, the pin 155 moves relative to the coupling assembly 156 in the direction of reducing the gap 170*a*. The regulating portion 1510 is set such that even if the angular position of the coupling assembly 156 changes, in this state, at least one of the engagement depths 170*b* in an angular positions which the coupling assembly 156 can take is larger than 0.

Figure 39:
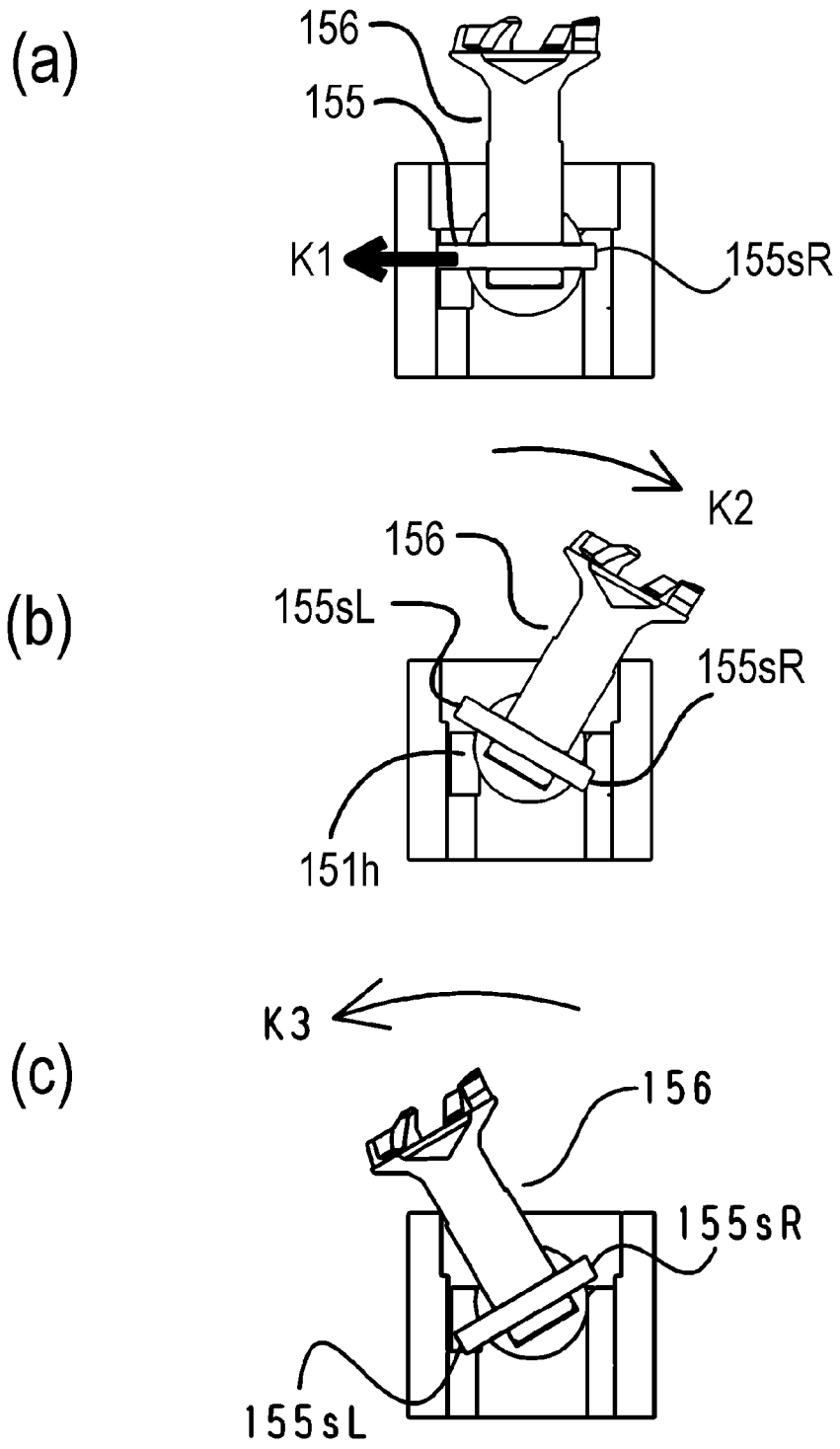
FIG. 39 is a sectional view illustrating the engagement depth in the embodiment of the present invention.

The description will be made in further detail as to the inclination and the engagement depth. FIG. 39 is a sectional view illustrating the inclination of the coupling and the engagement depth.

Here, the side near to the rotational force receiving portion 150*e* is an outside, and the opposite side near to the photosensitive drum is an inside with respect to the direction of the axis L1 of the photosensitive drum.

As shown in (a) of FIG. 39, when the coupling assembly 156 is in the rotational force transmitting angular position, and a slipping occurs between the pin 155 and the spherical member 160, the pin 155 is moved in the gap 170*a* in the direction (direction in which the pin projects) of an arrow K1. At this time, a projecting distance becomes small in a right side end 155*s*R in (a) of FIG. 39. In this state, when the coupling assembly 156 inclines in a direction of the arrow K2 in (b) of FIG. 39, the left-hand end portion (large projecting distance end) of the pin 155 155*s*L is in the outside of the rotational force transmitting portion 151*h*, the engagement depth may be 0. The position of the regulating portion 150*o* is set, such that even at this time the movement distance of the pin 155 is regulated beforehand, the engagement depth in few projecting distance end 155*s*R (right side end) is larger than 0.

More particularly, the engagement depth between the small projecting distance side of the pin 155 and the rotational force transmitted portion 151*h* and the rotational force transmitting opposing portion 151*r* is larger than 0, when the coupling assembly 156 inclines so that the side in which the projecting distance of the pin 155 is small moves relative to the flange 151 inwardly in an axial direction of the drum flange in the state that the coupling assembly 156 is in the rotational force transmitting angular position and the one end of the pin 155 contacts to the regulating portion 1510 to such an extent that the movement is limited.

As shown in (c) of FIG. 39, on the contrary, even in the case that the coupling assembly 156 inclines in the direction of an arrow K3, and the right side end 155*s*R is to the outside of a rotational force transmitting portion 151*h* the engagement depth in the left side end 155 of the large projecting distance sL is larger than 0.

Figure 40:
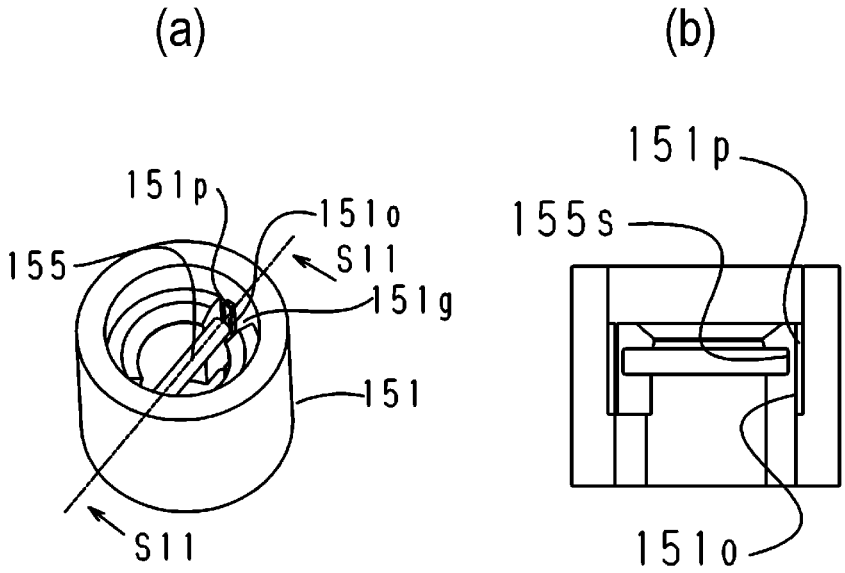
FIG. 40 is a sectional view and a perspective view illustrating a regulation rib in the embodiment of the present invention.
Figure 41:
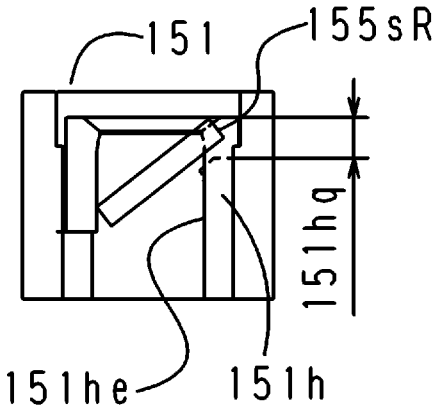
FIG. 41 is a sectional view illustrating an extension of a rotational force transmitted portion according to the embodiment of the present invention.
Figure 42:
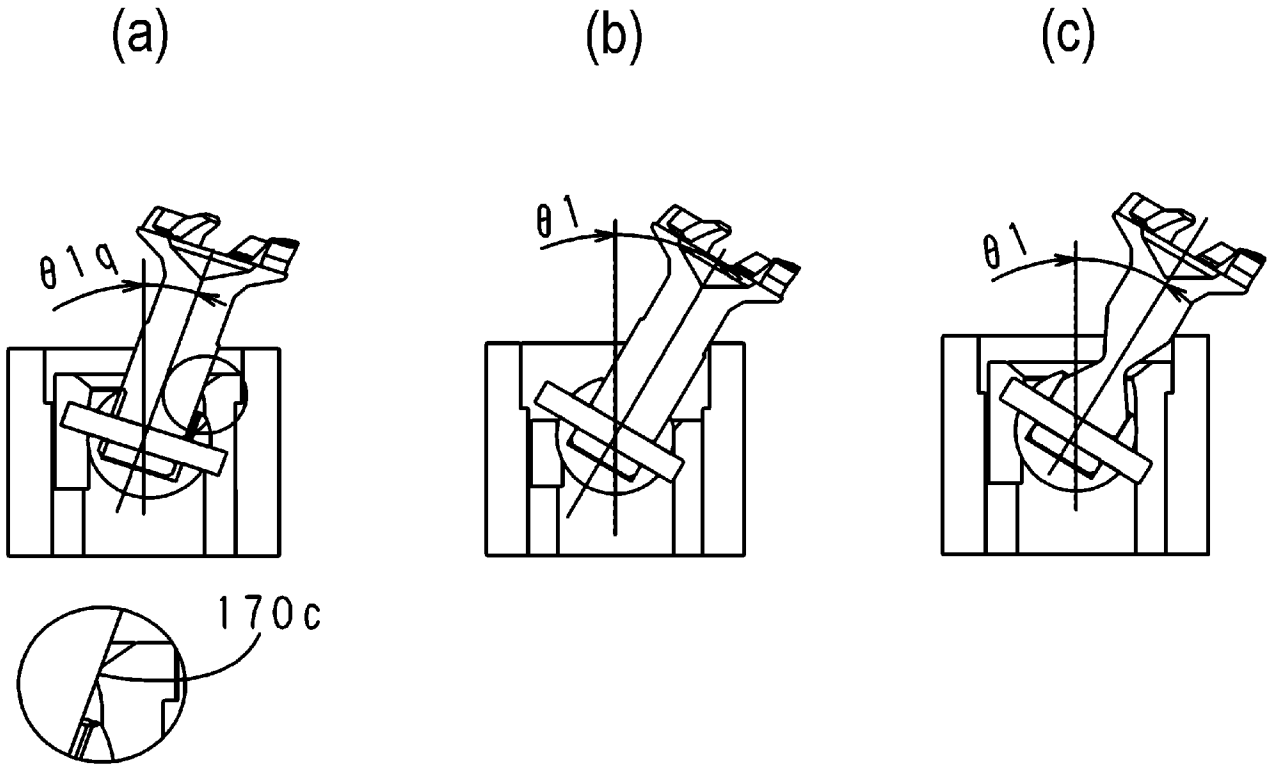
FIG. 42 is a sectional view illustrating the inclination of the coupling assembly according to the embodiment of the present invention.

Referring to FIG. 40-FIG. 42 the description will be made as to an example of the specific structure for increasing the engagement depth 170*b* when the angular position of the coupling assembly 156 changes from 0 in the state that the pin 155 has deviated in the direction of reducing the gap 170*a*. Part (a) of FIG. 40 is a perspective view illustrating the regulation rib 151*p*. Part (b) of FIG. 40 is a sectional view taken along the S11-S 11 line of (a) of FIG. 40. FIG. 41 is a sectional view illustrating the state that the rotational force transmitted portion 151*h* is extended. FIG. 42 is a sectional view illustrating the size of the inclination of the coupling assembly 156.

In the example shown in FIG. 40, the regulation rib 151*p* is provided in the opening portion 151*g*, and a top surface of the regulation rib 151*p* functions as the pin regulating portion 151*o*. By reducing the gap 170*a* by reducing a distance between the free end portion 155 of the pin s and the pin regulating portion 151*o*, the movement distance of the pin 155 when the coupling assembly 156 is in the rotational force transmitting angular position is regulated. In FIG. 40, for the sake of better illustration, only the pin 155 of the coupling assembly 156 is illustrated.

When the flange 151 is molded from the resin material, the position and the configuration of the regulation rib 151*p* is properly set, such that a thickness is uniform, and the moldability of a neighborhood of the opening portion 151*g* is enhanced. By this, in the case where an outer periphery of the flange 151 is provided with a gear or the like, accuracy thereof can be improved.

As shown in FIG. 41, in order to assure the engagement depth 170*b*, when the coupling assembly 156 inclines toward a maximum relative to a drum flange axis in the outside (FIG. 41, 155*sR* side) of drum flange 151, it would be considered that the end 151*he* of the rotational force transmitted portion 151*h* is extended outwardly with respect to an axial direction of drum flange 151, original configuration (broken line portion) to form an extension 151*hq*.

As shown in (a) of FIG. 42, however, in this case, when the coupling assembly 156 rotates the extension 151*hq* interferes with the coupling assembly by a contact portion 170*c*, and the rotation of the coupling assembly 156 is restricted ($\theta 1q<\theta 1$).

As shown in (c) of FIG. 42, on the contrary, in the case that while assuring a rotation range of the coupling assembly 156, the rotational force transmitted portion 151*h* is extended, it is preferable that a shaft portion (connecting portion) of the coupling assembly 156 is thin. However, when the shaft portion of the coupling assembly 156 is thin, the rigidity of the coupling assembly 156 decreases, and rotation unevenness at the time of the drive transmission occurs with the result that there may be the liability of deteriorating an image quality.

Therefore, it is desirable that the configuration for assuring the engagement depth 170*b* does not extend the rotational force transmitted portion 151*h*. For this reason, in this embodiment, the structure is such that when the coupling assembly 156 inclines toward the maximum relative to the drum flange axis, an outside end of the rotational force transmitted portion 151*h* is placed in the inside of the free end of the pin moved by the inclination outwardly with respect to the axial direction. By this, the limitation to the rotation is reduced without decreasing the rigidity of the coupling assembly 156.

As stated above, according to this embodiment, the management of the fixing method of the pin 155 relative to the coupling assembly 156 is easy (press-fitting relation between the pin 155 and the through-hole 160*b* for example,). By reducing an insertion pressure, the material which conventionally requires high pressure insertion with the liability of the crack is usable, and the latitude of material selection is improved. Furthermore, the engagement depth of the pin 155 relative to the rotational force transmitted portion 151*h* can be assured, and the rigidity of the coupling assembly 156 can be maintained without changing the configuration of the coupling 150. Therefore, the rotation unevenness at the time of the rotational force transmission can be reduced, and the reduction of the image quality is prevented.

<Rotational Force Transmitting Operation>

Figure 43:
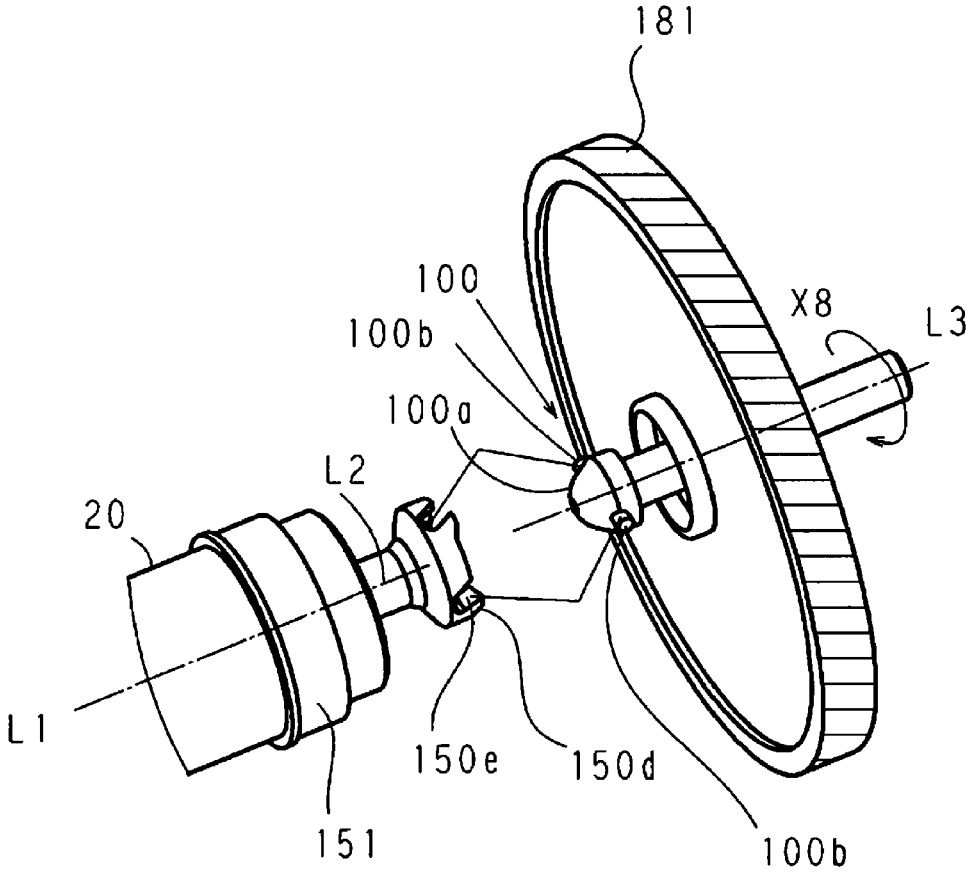
FIG. 43 is an exploded perspective view illustrating the drive shaft, a driving gear, a coupling and a drum shaft according to the embodiment of the present invention.

Referring to FIG. 43, the description will be made as to the rotational force transmitting operation at the time of rotating the photosensitive drum 20. By the rotational force received from the motor (unshown) the drive shaft 100 is rotated together with a drum driving gear 181 in the direction of X8 in the Figure. The gear 181 is a helical gear and the diameter thereof in this embodiment is about 80 mm. The pin 100*b* integral with the drive shaft 100 contacts to the two of the four receiving surfaces 150*e* of the coupling 150 (rotational force receiving portions). The coupling 150 is rotated by the pin 100*b* pushing the receiving surface 150*e*. The rotational force transmitting pins 155 of the coupling 150 (coupling side engaging portion, rotational force transmitting portion, and FIG. 11) contact to the rotational force transmitted portions 151*h*1, 151*h*3, or 151*h*2 or 151*h*4 (FIG. 13). By this, the coupling 150 can transmit the rotational force to the photosensitive drum 20. Therefore, by the rotation of the coupling 150, the photosensitive drum 20 is rotated through the flange 151.

The coupling 150 inclines slightly. By this, the coupling 150 can be rotated, without applying a large load to the photosensitive drum 20 and the drive shaft 100. For this reason, in assembling the drive shaft 100 and the photosensitive drum 20 the high precision adjustment is unnecessary. Therefore, the manufacturing cost can be reduced.

With the structure as described above, the photosensitive drum unit in which the coupling 150 is integral with the photosensitive drum are provided. For this reason, a handling is easy at the time of the assemblying, and the assemblying property can be improved.

In this embodiment, the drum flange at the driving side is unintegral relative to the photosensitive drum, but this is not inevitable. That is, the rotational force transmitted portion may not be provided on the drum flange, and it may be directly provided to a drum cylinder. According to this embodiment, the rotational-driving-force-transmitting member is set in the case where it engages into the coupling member by a press-fitting, the lower limit side of a tolerance to interference between the rotational-driving-force-transmitting member and the through-hole can be eased. By this, the insertion pressure in the upper limit side of a tolerance of the interference can be reduced, and the material which requires the high pressure insertion with the liability of the crack is usable, by which the latitude of material selection is improved. According to this embodiment, the engagement depth relative to the rotational force transmitted portion of the rotational force transmission projection can be assured and the rigidity of the coupling member can be maintained without changing the configuration of the coupling member. Therefore, the rotation unevenness at the time of the rotational force transmission can be reduced, and the reduction of the image quality can be prevented.

<Second Embodiment>

Figure 44:
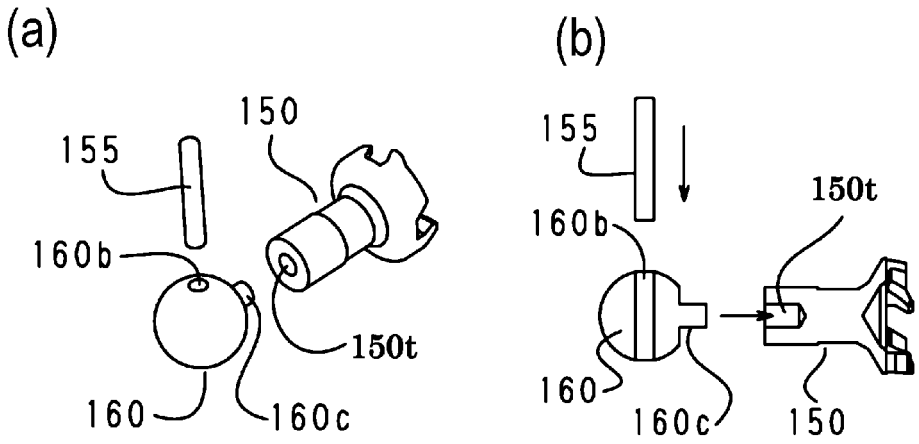
FIG. 44 is a perspective view illustrating the structure of the coupling assembly according to a second embodiment of the present invention, and a sectional view.
Figure 45:
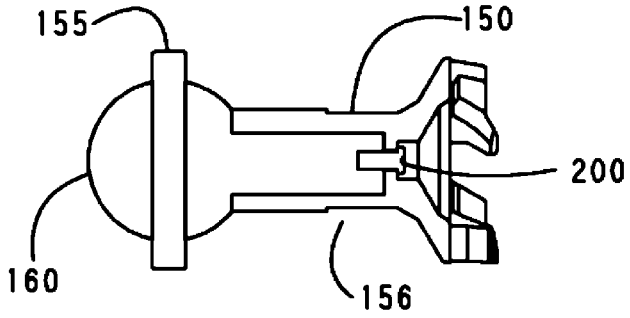
FIG. 45 is a sectional view of a coupling and a spherical member secured by screw according to the second embodiment of the present invention.
Figure 46:
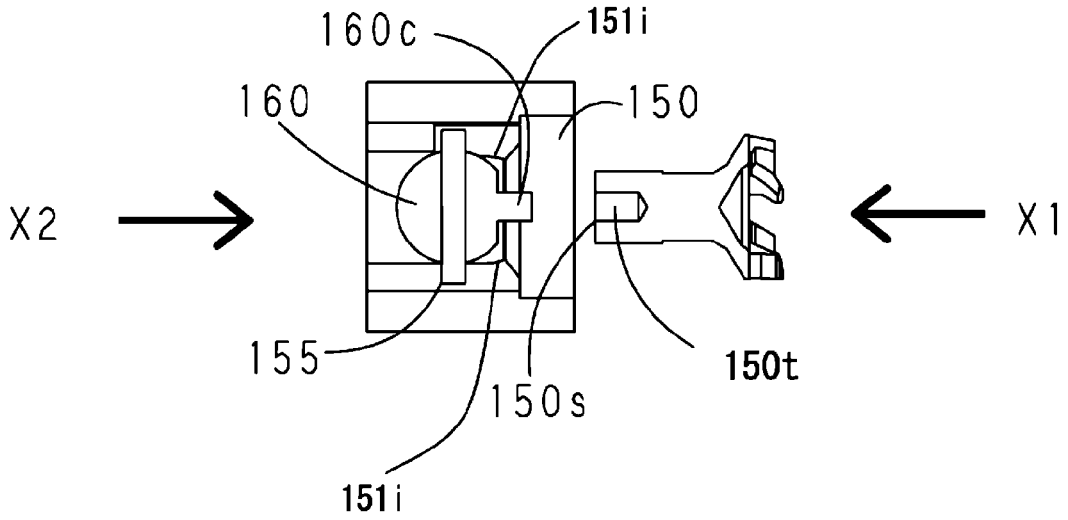
FIG. 46 is a sectional view illustrating the process in which the coupling assembly is fixed to the flange in the second embodiment of the present invention.

Referring to FIG. 44-FIG. 46 the description will be made as to a device according to the second embodiment. The basic structures of the device of this embodiment is the same as that of the embodiment described above, and therefore the redundant description is omitted for the sake of simplicity. The like reference numerals as in the foregoing embodiments are assigned to the elements having the corresponding functions.

<Coupling Assembly (Spherical Member and Coupling)>

These embodiments are different in the structure of the coupling assembly 156 from the first embodiment. In the coupling assembly 156 of this embodiment, the coupling 150 and the spherical member 160 are connected directly to each other using a connecting portion 150*t* provided in the coupling 150 and the connecting portion 160*c* provided for the spherical member 160.

Part (a) FIG. 44 is a perspective view illustrating the coupling assembly of this embodiment, and (b) FIG. 44 is a sectional view illustrating the connection of the coupling 150 and the spherical member 160. FIG. 45 is a sectional view of the coupling 150 and the spherical member 160 secured with each other on the screw.

As shown in FIG. 44, the coupling 150 is provided with the connecting portion 150*t*, and the spherical member 160 is provided with the through-hole 160*b* and the connecting portion 160*c*.

The pin 155 is inserted into the through-hole 160*b*, and is fixed by the insertion pressure or the like between the through-hole 160*b* and the pin 155, so that the opposite ends of the pin project out.

The connecting portion 160*c* provided in the spherical member 160 is fixed by the bonding and welding or the like to the connecting portion 150*t* provided in the coupling 150, by which, the coupling 150 and the spherical member 160 are connected integrally. The connecting portion 150*t* and the connecting portion 160*c* may be provided with the thread grooves, to secure each other. In this case, the thread grooves are formed in the direction of tightening the screw when the coupling assembly transmits the driving force. As shown in FIG. 45, unintegral parts, such as the screw 200, may be used.

By this, the integral coupling assembly 156 of the coupling 150, the spherical member 160, and the pin 155 is constituted.

<Coupling>

Referring to FIG. 46, the description will be made as to the process of the mounting of the coupling assembly 156 which is provided with the connecting portion 150*t* and the connecting portion 160*c* relative to drum flange 151. FIG. 46 is a sectional view illustrating the process in which the coupling assembly 156 is fixed to drum flange 151.

1. The pin 155 is inserted into the through-hole 160*b* provided in the spherical member 160 and they are fixed with each other by the insertion pressure or the like between the through-hole 160*b* and the pin 155, so that the opposite ends of the pin project out.

2. As shown in FIG. 46, the spherical member 160 and the pin 155 are inserted in the direction of an arrow X2 into the flange 151.

3. With the process similar to a process described referring to FIGS. 44 and 45, the coupling assembly 156 is assembled.

By this, the coupling assembly 156 is formed in the retainer 151*i* of drum flange 151.

As shown in FIG. 16, the subsequent processes are similar to those of the first embodiment, and the coupling assembly 156 is moved in the direction X4, and the spherical member 160 is contacted or approached to the retaining portion 151*i*. Subsequently, the retaining member 157 (FIG. 16) is inserted in the direction of the arrow X4, and is fixed to the flange 151. By this, a play (gap) is provided relative to the spherical member 160, and therefore, the coupling 150 can be deflected.

By such a method, the coupling assembly 156 is constituted, and the effects similar to the first embodiment are provided. In this embodiment, after engaging the pin 155 into the spherical member 160, the spherical member 160 is assembled into the flange 151 and connected with the coupling 150. For this reason, the mounting of the coupling assembly is easy.

<Third Embodiment>

Referring to FIG. 47-FIG. 50 the description will be made as to the device according to the third embodiment. The basic structures of the device of this embodiment are the same as that of the first embodiment, and therefore, the redundant description is omitted. The like reference numerals as in the foregoing embodiments are assigned to the elements having the corresponding functions.

<Coupling Assembly (Integral Spherical Member and Coupling)>

Figure 47:
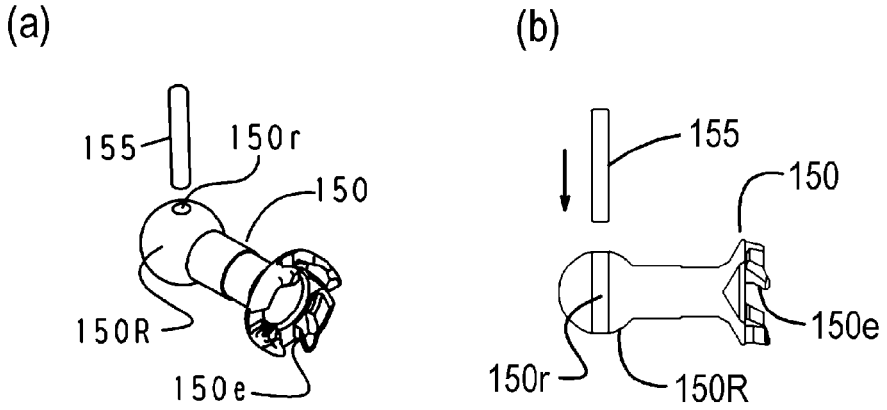
FIG. 47 is a perspective view and a sectional view illustrating the coupling assembly according to a third embodiment of the present invention.

Part (a) of FIG. 47 is a perspective view illustrating the coupling assembly, and part (b) of FIG. 47 is a sectional view illustrating the coupling assembly.

These embodiments are different in the structures of the coupling assembly 156 and the flange 151 from the first embodiment. As shown in (a) and (b) of FIG. 47, the coupling 150 of this embodiment comprises the substantially spherical portion 150R which is provided with the through-hole 150*r*. The pin 155 is inserted into the through-hole 150*r*, and is fixed by the insertion pressure or the like between the through-hole 150*r* and the pin 155 such that the opposite ends of the pin project out.

By this, a coupling assembly 156 which is the integral assembly of the coupling 150 and the pin 155 which is provided with the substantial spherical portion 150R is formed.

<Assemblying of the Coupling Assembly (Integral Coupling and Spherical Member)>

Figure 48:
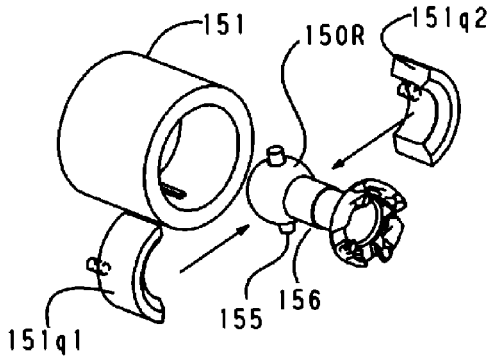
FIG. 48 is a perspective view illustrating a mounting method of the coupling assembly according to the third embodiment of the present invention.
Figure 49:
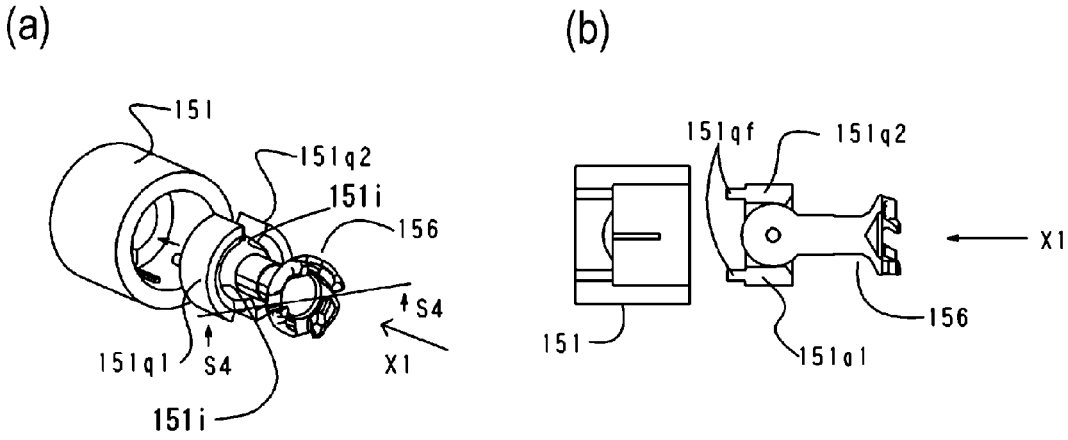
FIG. 49 is a perspective view and a sectional view illustrating the mounting method of the coupling assembly according to the third embodiment of the present invention.
Figure 50:
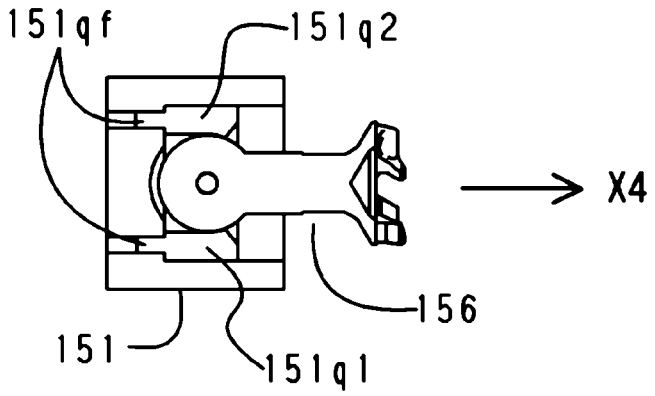
FIG. 50 is a sectional view of the attached coupling assembly according to the third embodiment of the present invention.

Referring to FIG. 48-FIG. 50, the process in which the coupling assembly 156 is fixed to the flange 151 will be described.

Part (a) of FIGS. 48 and 49 are perspective views illustrating a mounting method of the coupling assembly 156. The parts (b) of FIG. 49 and FIG. 50 are the sectional views taken along S4-S4 of (a) of FIG. 49 for the mounting method between the coupling assembly 156 and drum flange 151 to be shown.

Here, the retaining portion 151*i* of the drum flange 151 comprises the separate retaining members 151*q* (151*q*1, 151*q*2). The retaining member 151*q* functions as the retaining portion 151*i*, and has a radius SR151 (FIG. 14), wherein by fixing it to drum flange 151, the coupling assembly 156 is prevented from disengaging in the direction in FIG. 50X4. It is provided with a stationary portion 151 for being fixed to drum flange 151*qf*. The coupling assembly 156 is fixed to the flange 151 as follows.

1. The pin 155 is inserted into the through-hole 150*r* provided in the substantial spherical portion 150R, so that the opposite ends thereof project out, and they are fixed by the insertion pressure or the like between the through-hole 150*r* and the pin 155, by which a coupling assembly 156 is constituted.

2. As shown in FIG. 48, subsequently the retaining members 151*q*1 and 151*q*2 cap the substantial spherical portion 150R, so that the substantial spherical portion 150R is sandwiched from the respective sides.

3. As shown in FIG. 49, the coupling assembly 156 and the retaining member 151*q* are moved in an X1 direction, and are accommodated in drum flange 151.

4. As shown in FIG. 50, the stationary portion 151*qf* of the retaining member 151*q* is fixed to drum flange 151 integrally with drum flange 151 by the method of the bonding and welding or the like.

By this, the coupling assembly 156 is disposed in the retainer portion 151 of drum flange 151*q*.

The coupling assembly 156 is constituted by such a method, and also in this case, the effect similar to the first embodiment can be provided. In this embodiment, the coupling assembly 156 which includes the substantially spherical portion 150R can be molded integrally from the resin material or the metal, and therefore, the molding is easy, and in addition, the rigidity can be enhanced.

<Fourth Embodiment>

Figure 51:
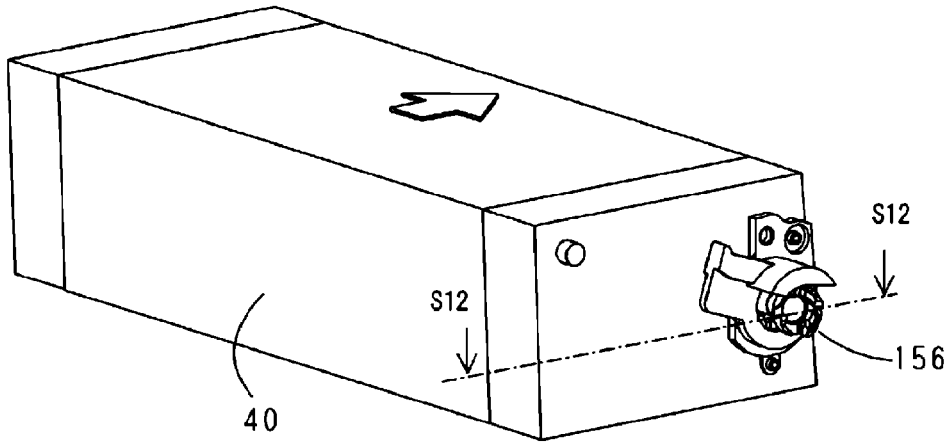
FIG. 51 is an illustration of a developing cartridge according to a fourth embodiment of the present invention.
Figure 51:
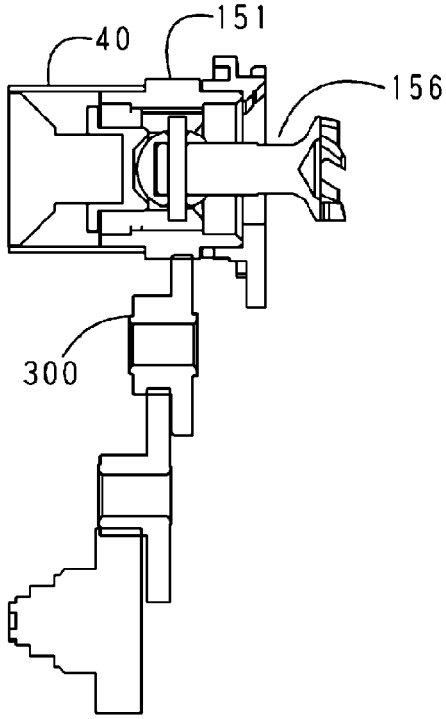
Figure 52:
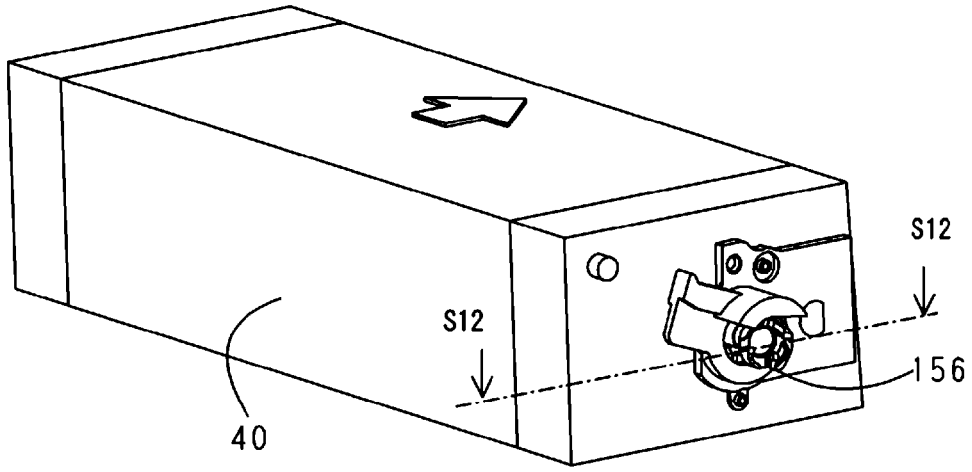
FIG. 52 is an illustration of the developing cartridge according to the fourth embodiment of the present invention.
Figure 52:
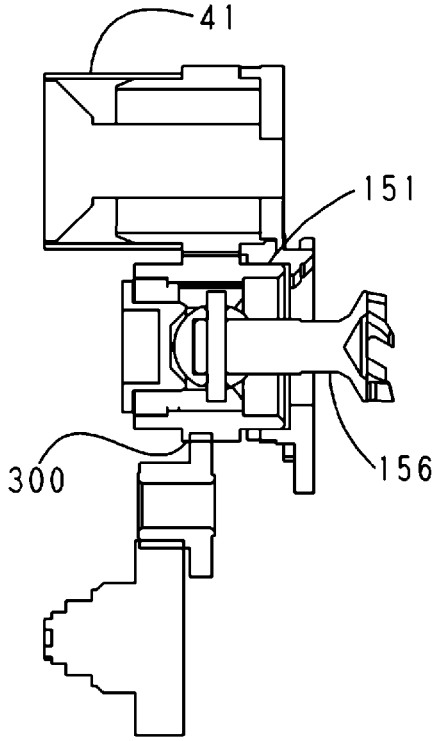

Referring to FIGS. 51 and 52, the description will be made as to the device according to the fourth embodiment. The basic structures of the device of this embodiment are the same as those of the first embodiment described above, and therefore the overlapping description is omitted. The like reference numerals as in the foregoing embodiments are assigned to the elements having the corresponding functions.

In the embodiment described above, the coupling assembly 156 and the flange 151 are mounted to the end of the photosensitive drum 20. However, the flange 151 may be mounted to the end of a developing device 40 which can be mounted and demounted independently relative to the main assembly of the image forming apparatus.

FIGS. 51 and 52 are a perspective view and a sectional view of the developing device 40. The part (b) of FIG. 51, and (b) of FIG. 52*s* are the sectional views of a driving train of the developing roller 41 taken along S12-S12 line of the part (a) of FIG. 51, and (b) of FIG. 51.

As shown in FIG. 51, in this embodiment, the flange 151 of the embodiment described above is directly mounted to a shaft end of the developing roller 41 not to the photosensitive drum 20. The developing device 40 is detachably mountable relative to the image forming apparatus main assembly 1, and the rotational force is directly transmitted to the developing roller 41.

In FIG. 52, an idler gear 300 which drives the developing roller 41 is used as the flange 151, and by the rotational force being transmitted to the idler gear 300 the developing roller 41 is driven.

With respect to the structures of the coupling assembly 156, they are similar to the second embodiment and third embodiment.

As has been stated before, when the flange 151 is mounted to the end of the developing device 40, the effect similar to the first embodiment can be provided.

While the invention has been described with reference to the structures disclosed herein, it is not confined to the details set forth, and this application is intended to cover such modification or changes as may come within the purposes of the improvements or the scope of the following claims.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 045057/2009 filed Feb. 27, 2009 which is hereby incorporated by reference.

What is claimed is:

1. A cartridge comprising:

a rotatable member which is rotatable about an axis;

a hollow cylindrical portion configured to transmit a rotational force to said rotatable member, said hollow cylindrical portion being provided with a first inner groove and a second inner groove extending in parallel with an axis of said hollow cylindrical portion at diametrically opposite positions;

a coupling member having a substantially spherical base portion and a pin penetrating said spherical base portion and having a first end portion and a second end portion opposite said first end portion, wherein said first and second end portions are projected outside said spherical base portion, wherein said pin is movable in an axial direction thereof relative to said spherical base portion, wherein said first end portion and said second end portion are engaged with said first inner groove and said second inner groove, respectively, when an axis of said coupling member is coaxial with the axis of said hollow cylindrical portion, wherein said coupling member is capable of inclining relative to said hollow cylindrical portion substantially about a center of said spherical base portion within a predetermined inclination range; and a limiting portion, provided in said first inner groove, for limiting the movement of said pin in the axial direction thereof in a state the axis of said coupling member is coaxial with the axis of said hollow cylindrical portion and a projecting length of said first end portion is greater than a projecting length of said second end portion, wherein when said coupling member is inclined to a maximum extent within the predetermined inclination range, after the movement of said pin is limited by said limiting portion in the state, so that said first end portion moves away from said rotatable member and said second end portion moves toward said rotatable member, said first end portion is disengaged from said first inner groove, whereas said second end portion is engaged with said second inner groove.

2. The cartridge according to claim 1, wherein said hollow cylindrical portion is provided on a longitudinal end of said rotatable member,

3. The cartridge according to claim 1, wherein said rotatable member comprises an electrophotographic photosensitive member.

4. The cartridge according to claim 1, wherein said rotatable member comprises a developing member.

5. The cartridge according to claim 1, wherein said limiting portion comprises a rib projected from an inner surface of said first inner groove.

6. The cartridge according to claim 5, wherein said rotatable member comprises an electrophotographic photosensitive member.

7. The cartridge according to claim 5, wherein said rotatable member comprises a developing member.

* * * * *